US006073766A

United States Patent [19]

Winnard

[11] Patent Number: 6,073,766

[45] Date of Patent: Jun. 13, 2000

[54] MAGNETIC TOOL ORGANIZERS, AND TOOL BOX WITH MAGNETIC ORGANIZERS

[76] Inventor: Stanley D. Winnard, 2528 Clear Spring North, Irving, Tex. 75063

[21] Appl. No.: 08/843,039

[22] Filed: Apr. 4, 1997

Related U.S. Application Data

[60] Division of application No. 08/318,912, Oct. 5, 1994, Pat. No. 5,660,276, which is a continuation-in-part of application No. 08/161,724, Dec. 3, 1993, abandoned, which is a continuation of application No. PCT/US92/11370, Dec. 24, 1992.

[51] Int. Cl.[7] ..... A45C 11/26

[52] U.S. Cl. ..... 206/350; 206/376; 206/378

[58] Field of Search ..... 206/350, 376, 206/378, 486, 490, 589, 590, 818, 373; 211/70.6, DIG. 1

[56] References Cited

U.S. PATENT DOCUMENTS

| | | | |
|---|---|---|---|
| 2,580,099 | 12/1951 | Jaeger | 206/818 |
| 3,141,258 | 7/1964 | Mayer | 206/350 |
| 3,483,494 | 12/1969 | Cromie | 211/DIG. 1 |
| 3,610,459 | 10/1971 | Hanson | 206/818 |
| 3,727,658 | 4/1973 | Eldridge, Jr. | 206/818 |
| 3,868,016 | 2/1975 | Szpur et al. | 206/818 |
| 4,421,230 | 12/1983 | Stanton | 206/378 |

*Primary Examiner*—David T. Fidei
*Attorney, Agent, or Firm*—Sanford E. Warren, Jr.; Gardere & Wayne, L.L.P.

[57] ABSTRACT

A magnetic tool organizer has a top body member having a plurality of spaced apart body member apertures of a size and shape for accommodating at least one surface of a tool. The apertures are organized in a planar array according to an outline of at least one surface of a tool. The magnetic organizer has a bottom body member, and a magnetic segment having a plurality of spaced apart apertures complimentary to at least part of the top body member apertures. The magnetic segment is interposed between the top body member and the bottom body member. A method of manufacturing a tool display includes the steps of self-assembling a magnetically attracting tool retaining apparatus to a plurality of magnetically attractable tools by automatically positioning tools in apertures disposed on the tool retaining apparatus with a strong magnetic force emanating from the tool retaining apparatus as a result of the arrangement of the components of the tool retaining apparatus.

14 Claims, 22 Drawing Sheets

230
231
232
233
234
239
240
241
243
244
245
246
206
250
300
17
18

300

206
21
300

206
20
20
206
239
246
245

234
206
230
21
245

FIG. 35b
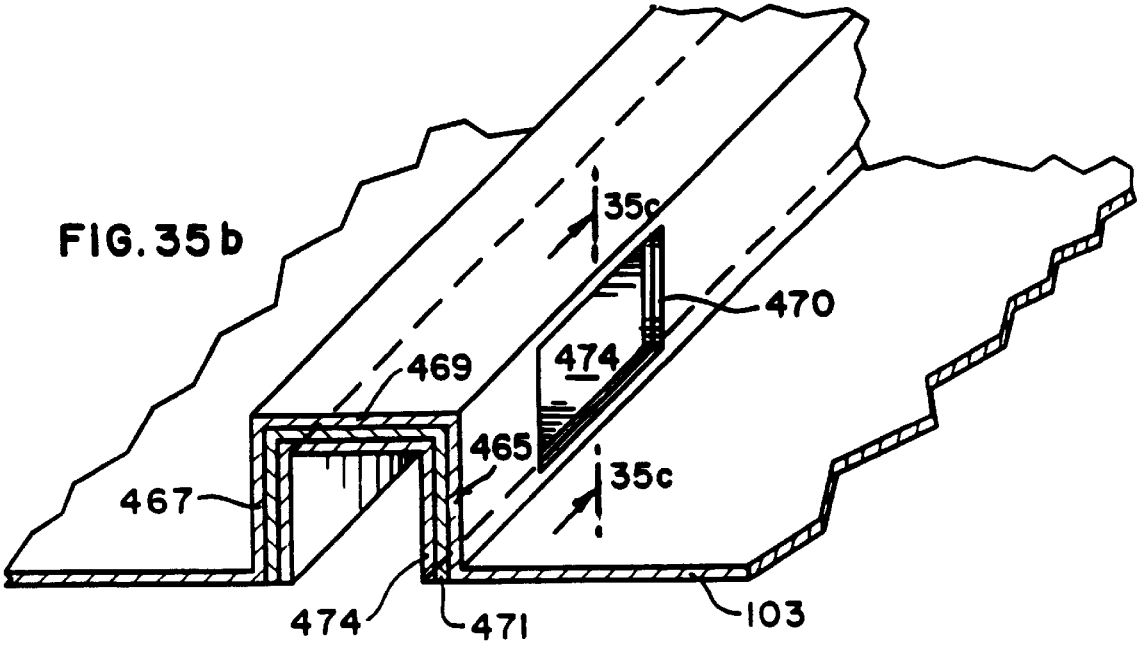
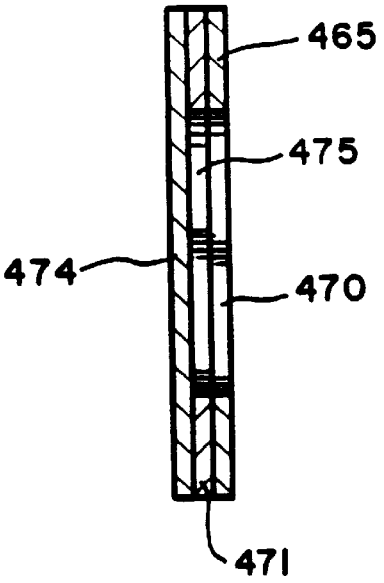
FIG. 35c

FIG. 37
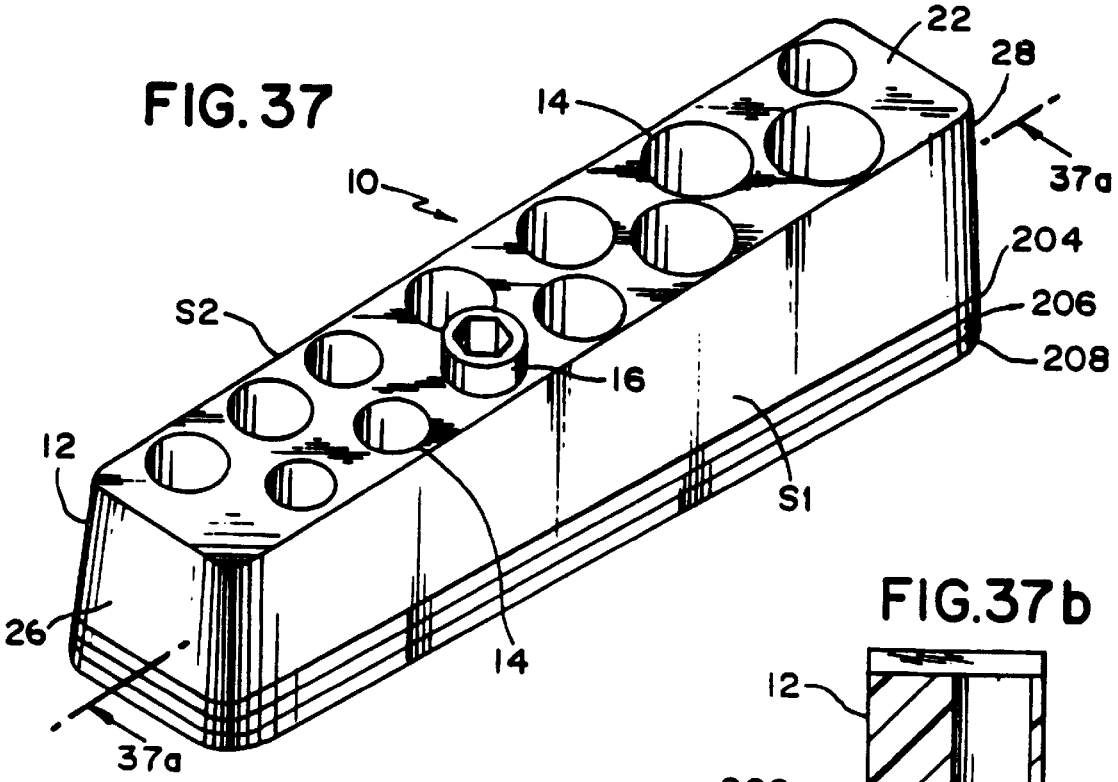
FIG. 37b
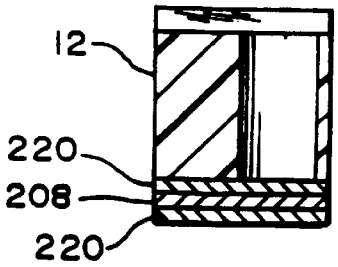
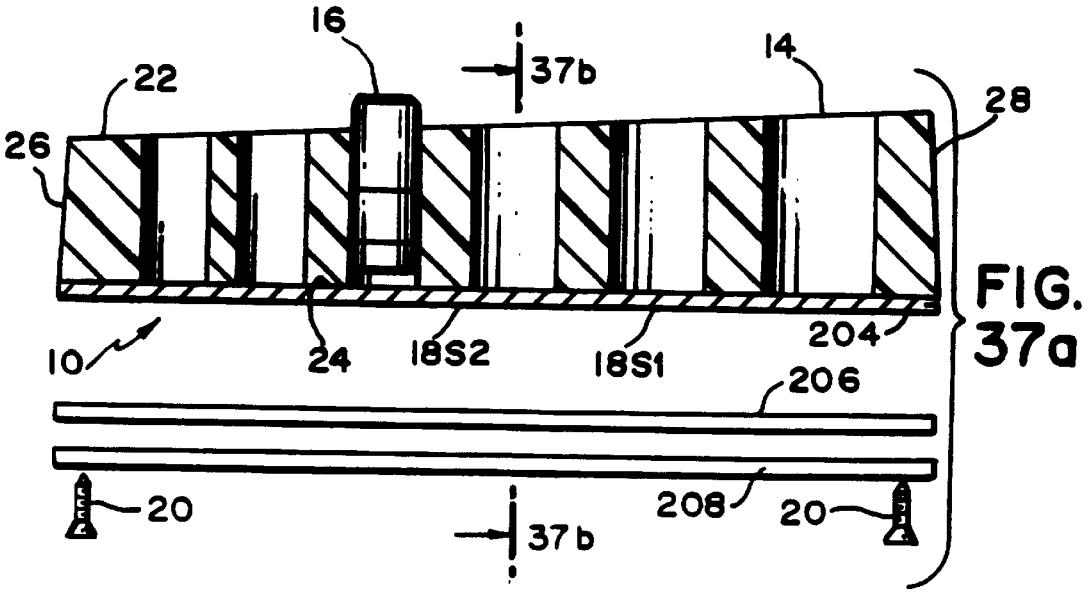
FIG. 37a

MAGNETIC TOOL ORGANIZERS, AND TOOL BOX WITH MAGNETIC ORGANIZERS

CROSS-REFERENCE TO RELATED APPLICATIONS

Claiming Benefit Under 35 U.S.C. 119 and 120

This is a divisional application of U.S. patent application Ser. No. 08/318,912 filed Oct. 5, 1994, now U.S. Pat. No. 5,660,276 issued Aug. 26, 1997 which application is a continuation-in-part application of now abandoned U.S. application Ser. No. 08/161,724, entitled "Tool Organizer" filed Dec. 3, 1993, which is a continuation of International Patent Application No. PCT/US92/11370, filed Dec. 24, 1992.

BACKGROUND OF THE INVENTION

This invention relates to tool organizers and a tool box; and, more particularly, it relates to magnetic tool organizers, and a tool box with magnetic organizers for use in connection with the organization and storage of tools. Recently, there has been a growing trend in the use of tool organizers and tool boxes among homeowners and do-it-yourselfer's for storing and organizing various hand tools. In addition to non-professionals, professional mechanics, in all areas of industry, have a need for storing and organizing their tools and components of machinery that are assembled and disassembled.

The rapid retrieval of a particular tool during a project, is a very desirable goal. However, this goal is not easily achieved. Devices created to assist in the rapid retrieval of tools include tool organizers and tool boxes.

Traditional tool organizers are large and bulky, and traditional tool box compartments only offer a limited amount of vertical clearance for the storage of tools. Hence, there exists a need for a tool organizer that can store and organize a tool and fit easily into the narrow space constraints of a tool box compartment.

Generally, tool boxes come with dividers for segregating tools. These dividers are useful for separating one tool type from another, e.g. screwdrivers from socket wrenches, but do not serve to organize and store tools of a particular type for rapid retrieval. A further problem with dividers includes the fact that tools within a divider compartment shift during transportation. The result is that tools are left in a state of disarray.

Tool organizers have the additional problem in that tools can be knocked out of compartments or knocked out of order in the tool organizer. By way of example, the tool organizer disclosed in U.S. Pat. No. 4,802,580 has this particular problem since the accidental movement of one tool causes the disorganization of other subsequent tools. The same problem holds true with the devices disclosed in U.S. Pat. Nos. 3,419,832, 4,544,067, 5,221,006, and 5,301,822.

Professional mechanics, and in particular, airline mechanics, also have a need for storing and organizing tools and engine components after disassembly. An airline mechanic must ensure that all parts that have been disassembled from an engine are placed back into the engine. Moreover, an airline mechanic must ensure that he has not accidentally left a tool in an engine compartment. An omitted engine component or accidentally placed tool in an engine compartment can have catastrophic consequences since the operation of an engine can be disrupted. Hence, there exists a need for tool organizer and tool case that can help inventory engine parts and tools, and reduce the risk of a tool being left in an engine compartment.

A further problem with traditional magnetic tool holders is that they do not shield magnetic flux lines emanating from their magnetic components. Magnetic flux lines can interfere with sensors and computer equipment and can disrupt their operation. This problem is particularly pressing in aircraft that rely on a host of sophisticated electronic equipment. Hence, there exists a need for a tool organizer that shields magnetic flux lines, and that can be used around computer equipment and delicate sensors.

Yet a further problem with traditional tool holders is that it is difficult to create tool displays with them. By way of example, traditional spring clip socket holders are used in combination with sockets for tool displays. However, creation of the tool displays requires that each respective socket be hammered into a spring clip on each tool holder. This adds manufacturing cost to the assembly of the tool display. Consequently, there exists a need for a tool organizer that can provide a method for assembling a tool display with minimized manufacturing cost.

SUMMARY OF THE INVENTION

The present invention further provides a magnetic tool organizer with a top body member having a plurality of spaced apart body member apertures of a size and shape for accommodating at least one surface of a tool. The apertures are organized in a planar array according to an outline of at least one surface of a tool. The magnetic organizer has a bottom body member, and a magnetic segment having a plurality of spaced apart apertures complimentary to at least part of the top body member apertures. The magnetic segment is interposed between the top body member and the bottom body member.

The present invention also provides a magnetic tool organizer that has a bottom body member with a plurality of spaced apart body member apertures of a size and shape for accommodating at least one surface of a tool. A magnetic segment is interposed between the top body member and the bottom body member.

The present invention further provides a tool box for use in the storage and organization of a tool that consists of a compartment floor, optionally, consisting of an indentation of a size and shape to accommodate a magnetic tool organizer, or an indentation accommodating a magnetic segment.

The present invention yet farther provides a method of assembling a tool display that consists of providing a magnetic tool organizer for organizing and storing a tool, and inserting a tool into an aperture disposed on the magnetic tool organizer.

The objects and features of the present invention, other than those specifically set forth above, will become apparent in the detailed description of the invention set forth below.

BRIEF DESCRIPTION OF THE DRAWINGS

FIG. 28 is a side cross sectional view of the magnetic tool holder of FIG. 29 along phantom line 30.

FIG. 35*b* is another embodiment of a tool box compartment floor of FIG. 32.

FIG. 35*c* is a cross sectional view of the tool box compartment floor of FIG. 35*b* along phantom line 35*c*.

FIG. 37 is a perspective view of a magnetic tool organizer for holding a plurality of tools with a non-metallic body member, a cover member, a bottom body member and an interior body member.

FIG. 37*a* is a cross sectional view of the magnetic tool holder of FIG. 37 along phantom line 37*a*.

FIG. 37*b* is a cross sectional view of another embodiment of the magnetic tool organizer of claim 37 wherein the cover member and the bottom body member is a metal.

DETAILED DESCRIPTION OF THE INVENTION

Figure 1:
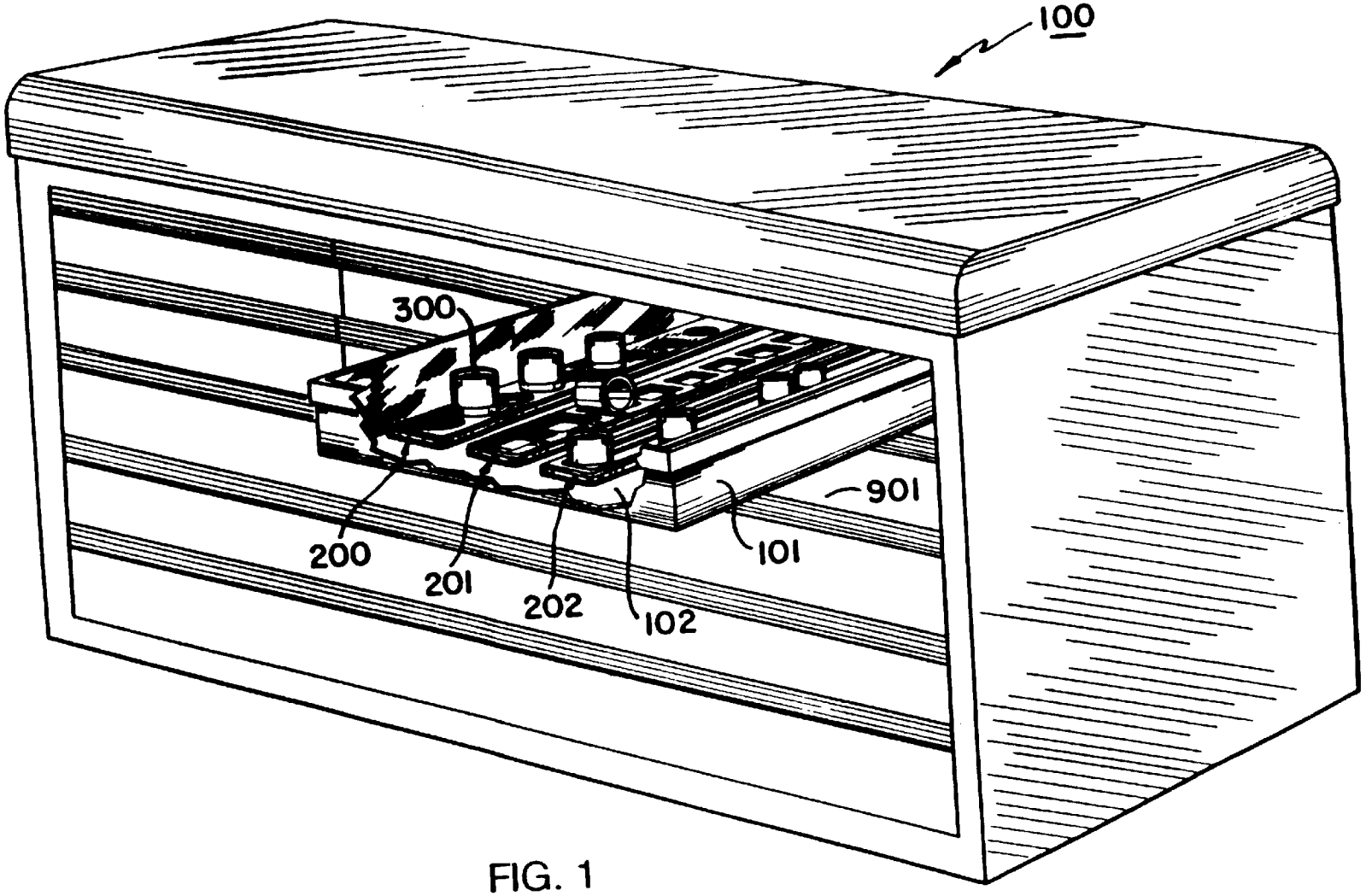
FIG. 1 is a perspective view of a tool box with a plurality of magnetic tool organizers disposed within a compartment of the tool box.

FIG. 1 is a perspective view of tool box 100 with a plurality of magnetic tool organizers 200, 201, 202. Magnetic tool organizers 200, 201, and 202 are disposed within a storage volume 102 defined by compartment 101 of tool box 100. Within each respective magnetic tool organizer 200, 201, 202 are disposed tools 300. In a preferred embodiment, tool box compartment 101 is slidingly disposed in tool box 100.

Figure 2:
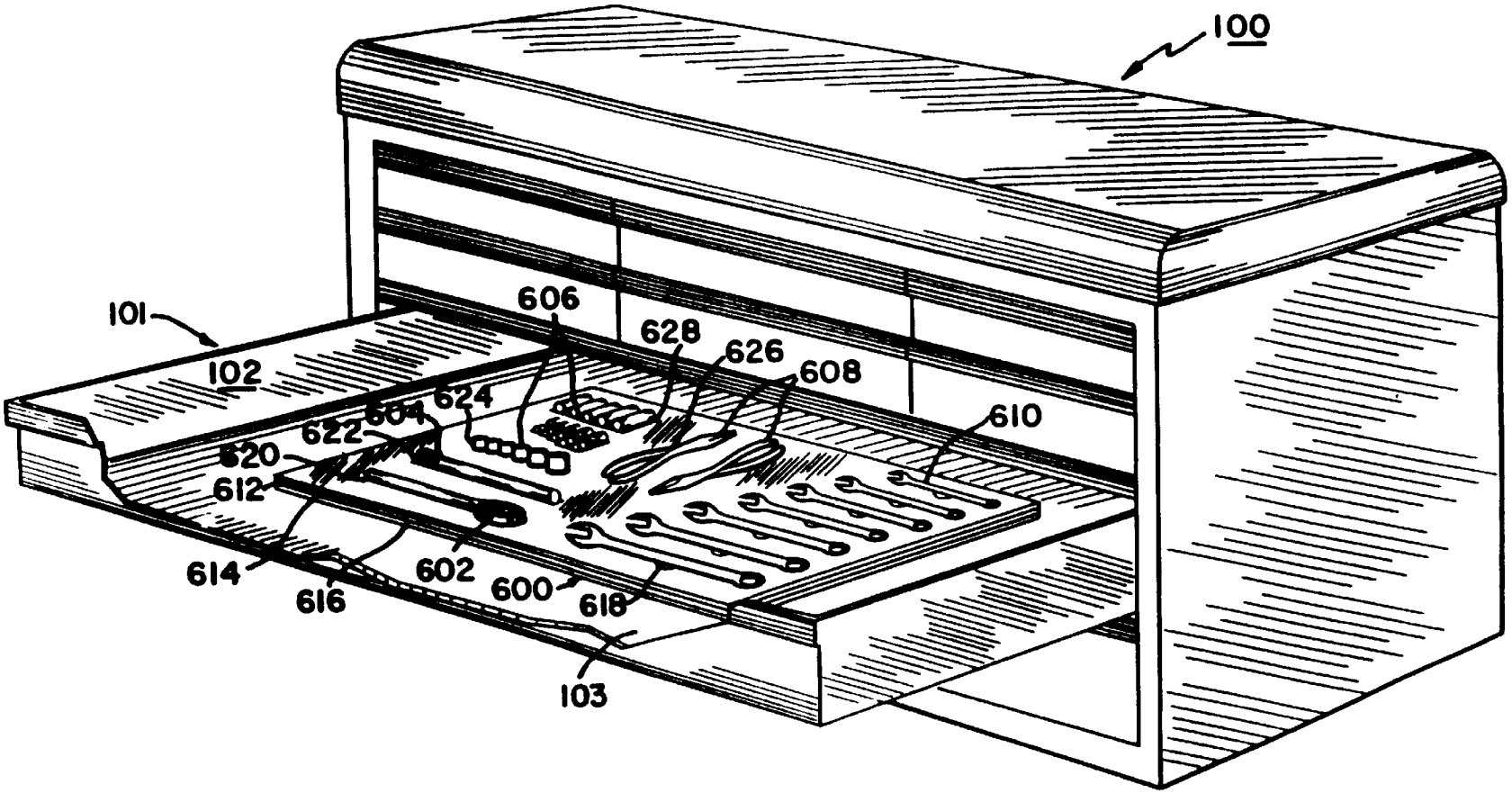
FIG. 2 is a perspective view of a compartment of a tool box with a tool holder page and tools disposed thereon.

FIG. 2 is a perspective view of compartment 100 of tool box 100 with tool holder page 600. Tool holder page 600 has a variety of tools disposed thereon. For example, tool holder page has a socket wrench 602, extension 604, sockets 606, pliers 608, and wrenches 610 disposed thereon.

Tool holder page 600 comprises a top body member 612 (FIGS. 2, 10, 11, and 13). Top body member 612 is analogous to top body member 204 of FIG. 3 and is constructed of a metal, wood, plastic, or other suitable material.

Figure 8:
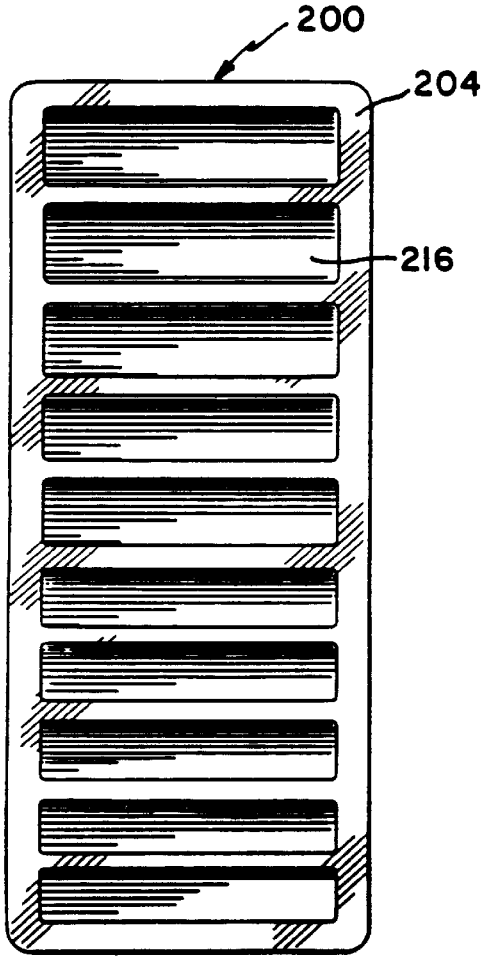
FIG. 8 is a top plan view of another embodiment of the magnetic tool organizer of FIG. 3.
Figure 9:
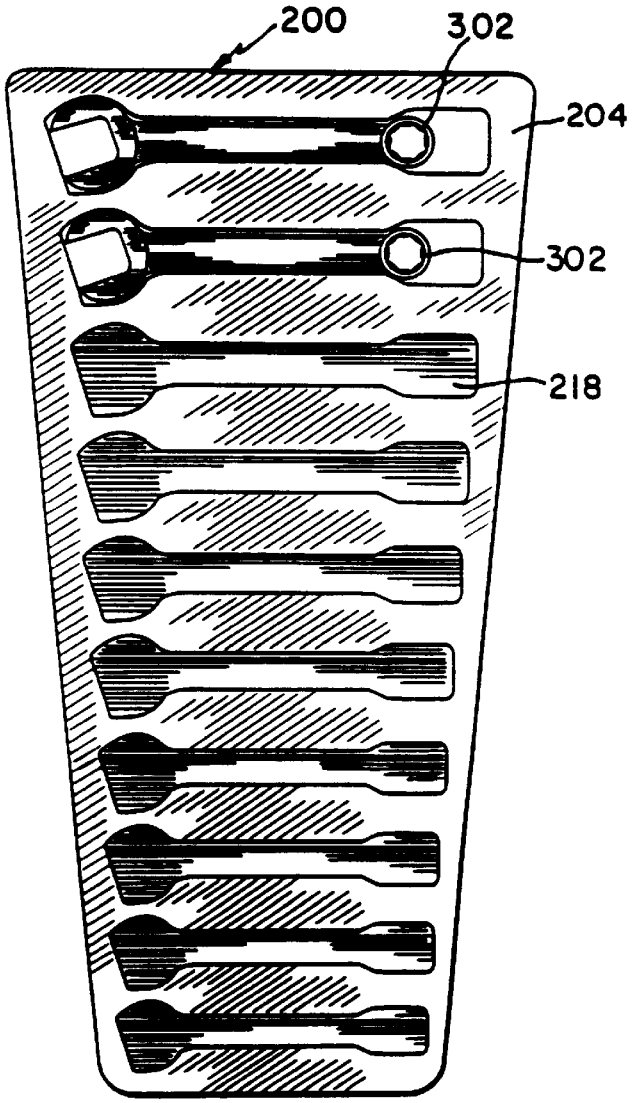
FIG. 9 is a top plan view of another embodiment of the magnetic tool organizer of FIG. 3 with the addition of two wrenches disposed within apertures on the magnetic tool organizer.

Top body member 612 has a plurality of spaced apart body member apertures 618, 620, 622, 624, 626, and 628 (FIGS. 2, 10, 11), analogous to body member apertures 204 (FIGS. 3, 6, 31), 212 (FIG. 5), 214 (FIG. 7), 216 (FIG. 8), 218 (FIG. 9). Body member apertures 618, 620, 622, 624, 626, and 628 are of a size and shape for accommodating at least one surface of a tool that is magnetically attractable to magnetic segment 614. By way of example, the apertures may be of a shape to accommodate socket wrench 602, e.g. aperture 620, a socket wrench extension, e.g. aperture 622, sockets 606, e.g. apertures 624, 628, pliers 608, e.g. apertures 626, or wrenches 610, e.g. 618. Apertures 618, 620, 622, 624, 626, 628 are organized in a planar array according to an outline of at least one surface of a tool in one embodiment.

Figures 3, 4, 5, 6, 7:
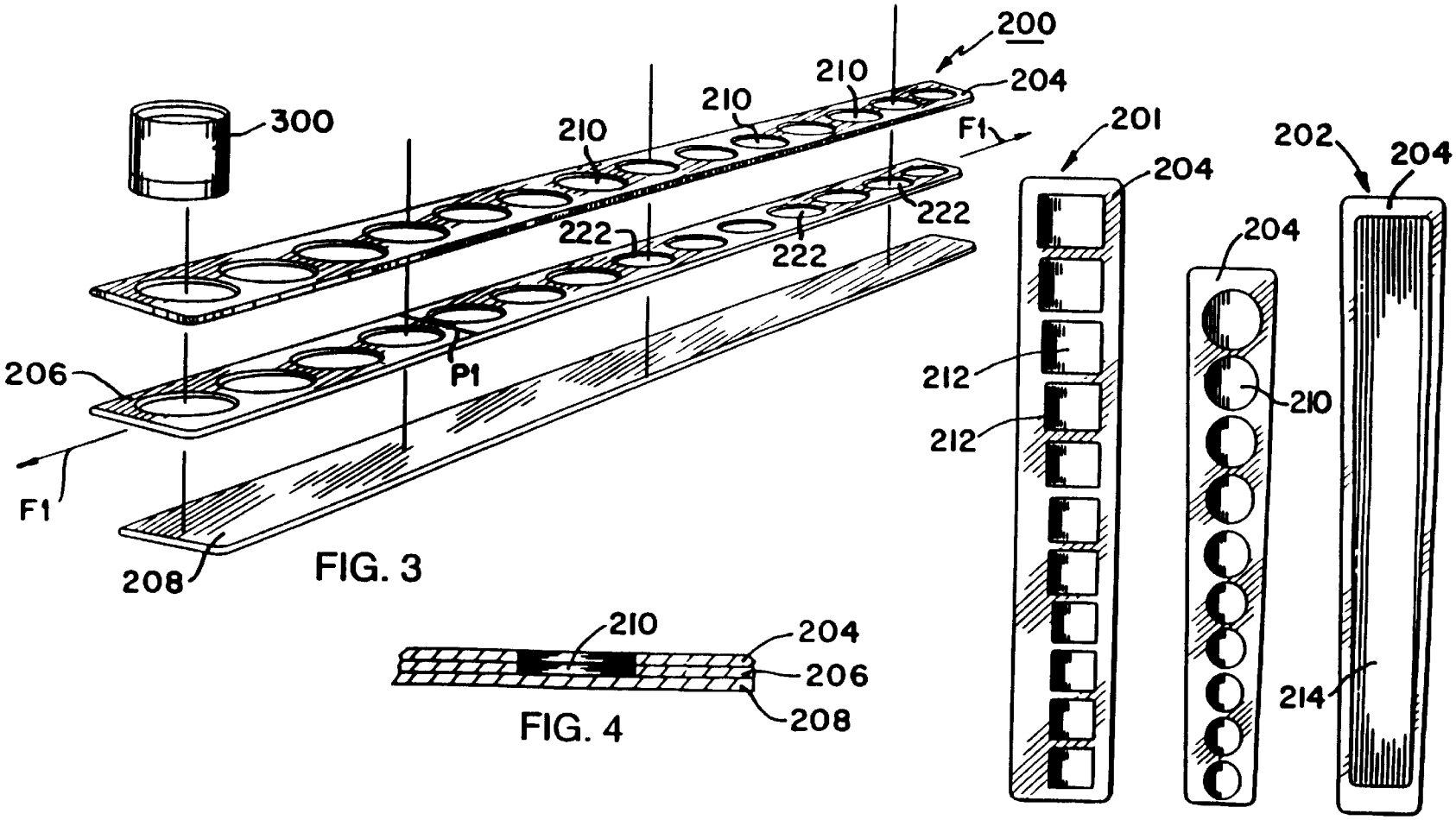
FIG. 3 is an exploded perspective view of a magnetic tool organizer and a socket.
FIG. 4 is a side cross sectional view of the magnetic tool organizer of FIG. 3 along phantom line 1.
FIG. 5 is a top plan view of another embodiment of the magnetic tool organizer of FIG. 3.
FIG. 6 is a top plan view of the magnetic tool organizer of FIG. 3.
FIG. 7 is a top plan view of another embodiment of the magnetic tool organizer of FIG. 3 wherein there is a single aperture.
Figures 31, 31A:
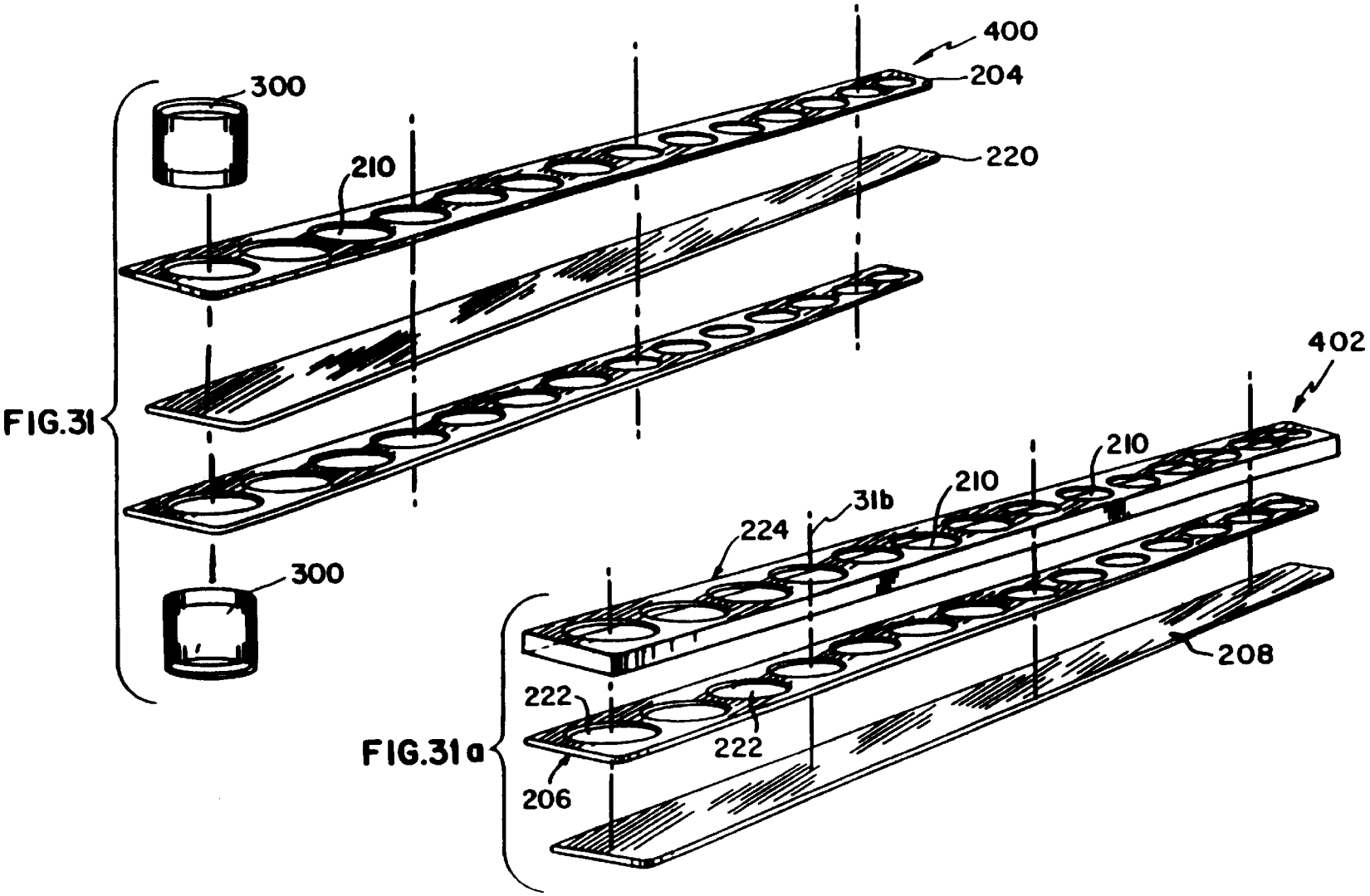
FIG. 31 is another embodiment of a magnetic tool holder with exterior and interior body members.
FIG. 31*a* is another embodiment of the magnetic tool holder of FIG. 3 wherein a magnetic segment is enclosed.

Tool holder page 600 comprises a bottom body member 616 (FIGS. 2, 10, 11, 13) analogous to bottom body member 208 (FIGS. 3, and 31*a*). Bottom body member 600 is constructed of any suitable material including a metal, wood, plastic, foam, rubber, and the like. In a preferred embodiment, bottom body member 616, top body member 612, or combination thereof, are constructed from steel.

Tool holder page 600 comprises a magnetic segment 614 (FIGS. 2, 10, 11, 13), analogous to magnetic segment 206 (FIGS. 3, 31*a–d*, 32, 33, and 35), and magnetic segment 220 (FIG. 31). Magnetic segment 614 is constructed from a flexible strip material formed from non-metallic binding material with magnetic material embedded therein available from Bunting Magnetic Co., Elkgrove Village, Ill. in one embodiment. A type of flexible strip material available from Bunting Magnetic Co. is Type W which as equal magnetic holding strength on both sides of the material. Alternately, a suitable powdered metallic material such as iron oxide, can be mixed with rubber while it is in liquid form. In a conventional manner, this metallic material can be magnetized subsequent to the molding of the material. Like magnetic segments 206, 220, magnetic segment 614 comprises a NITRILE Rubber Binder having embedded therein strips or rows of magnetic particles in one embodiment. This material is commercially available from 3M Corporation. Magnetic segments 206, 220, 614 are multi-pole magnets in one embodiment. Multi-pole magnets may have 2, 4, 6, etc. poles per inch. Magnetic segments 8, 76, 206, 220, 241, 254, 614 are standard magnets in yet a further embodiment.

Magnetic segment 614 may be attached to top member 612 and bottom member 616 (FIGS. 2, 10, 11, 13) by any suitable means. It will be appreciated that when top member 612 and bottom member 614 are constructed from steel or material embedded with ferrous particles, magnetic segments 614 will magnetically attract top member 612 and bottom member 616.

In a preferred embodiment, magnetic segment 614, analogous to magnetic segment 206, has a plurality of spaced apart apertures (not shown) complimentary to at least part of top body member apertures 618, 620, 622, 624, 626, 628. Magnetic segment 614 is interposed between top body member 612 and bottom body member 616 in a manner analogous to the interposition of magnetic segment 206 between top body member 204 and bottom body member 208 (FIGS. 3, 4, 31*a* and 35).

FIG. 3 is an exploded perspective view of magnetic tool organizer 200. Magnetic tool organizer 200 comprises a top body member 204 (FIGS. 3–9, 31, and 35). Top body member 204 is constructed of a metal, wood, plastic, or other suitable material.

Top body member 204 has a plurality of spaced apart body member apertures 210 (FIGS. 3, 6, 31), 212 (FIG. 5), 214 (FIG. 7), 216 (FIG. 8), 218 (FIG. 9). Body member apertures 210, 212, 214, 216, 218 are of a size and shape for accommodating at least one surface of a tool that is magnetically attractable. By way of example, the apertures may be circular (FIG. 3), e.g. aperture 210, rectangular, e.g. aperture 212 (FIG. 5), trapezoidal, e.g. aperture 214 (FIG. 7); or it the shape of a tool, e.g. wrench shaped (FIG. 9). Apertures 210, 212, 214, 216, 218 are organized in a planar array according to an outline of at least one surface of a tool in one embodiment. By way of example, as illustrated in FIG. 9, wrenches 302 are disposed in apertures 218.

Tool organizer 200 comprises a bottom body member 208 (FIGS. 3, and 31*a*). Bottom body member 208 is constructed of any suitable material including a metal, wood, plastic, foam, rubber, and the like. In a preferred embodiment, bottom body member, top body member, or combination thereof, are constructed from steel or other ferrous metal. Preferably, bottom body member and top body member are made of 14 gauge to 26 gauge ferrous metal.

Figure 25:
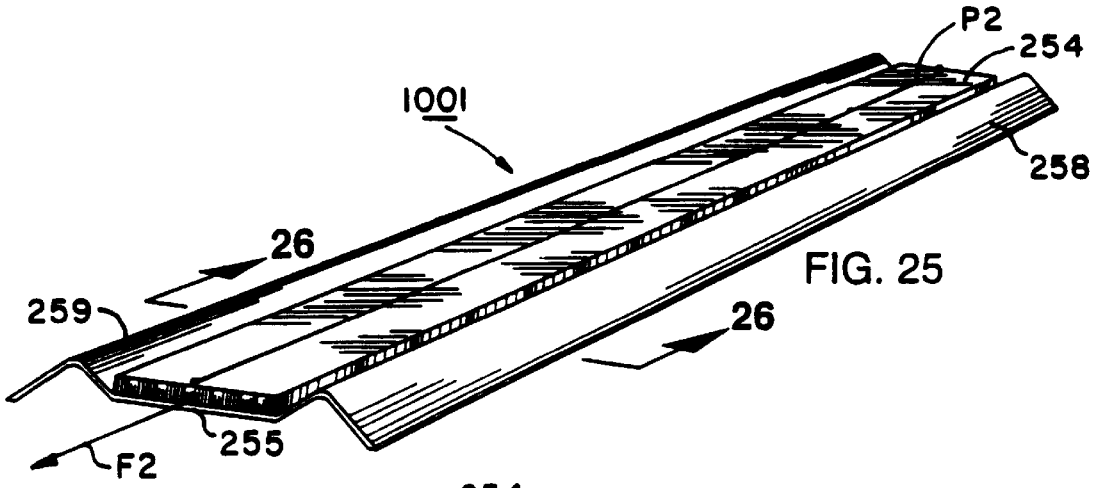
FIG. 25 is a perspective view of another embodiment of a magnetic tool holder.
Figure 26:
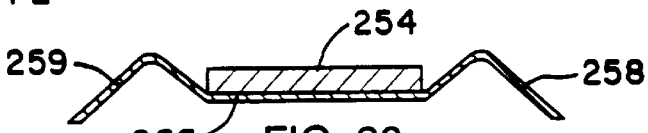
FIG. 26 is a side cross sectional view of the magnetic tool holder of FIG. 25 along phantom line 26.

Magnetic tool organizer 200 and tool box compartment floor 103 (FIGS. 33, 35, 35*a*) comprise a magnetic segment 206 (FIGS. 3, 31*a–d*, 32, 33, and 35), magnetic segment 220 (FIG. 31), respectively. Magnetic segments 206, 220 are constructed, analogous to segment 614 from a flexible strip material formed from non-metallic binding material with magnetic material embedded therein. A preferred type of flexible strip material available from Bunting Magnetic Co. is Type W which as equal magnetic holding strength on both sides of the material. Alternately, a suitable powdered metallic material such as iron oxide, can be mixed with rubber while it is in liquid form. In a conventional manner, this metallic material can be magnetized subsequent to the molding of the material. Magnetic segments 206, 220 comprise a NITRILE Rubber Binder having embedded therein strips or rows of magnetic particles. Magnetic segments 206, 220 comprise a Nordell Binder or can comprise a Natsen™ binder having embedded therein ferride material and rubber or plastic in one embodiment. Magnetic segments are commercially available from Magnetic Specialty, Inc., 707 Gilman Street, Marietta, Ohio or Arnold Engineering Company, 614 Edmonds Lane, Suite #206, Lewisville, Tex. 75067. The process of manufacturing flexible magnetic materials involves mixing, baking, pouring and injection molding the material in flat sheets. The flat sheets are then cut to a desired length, and then magnetized. Magnetic segment is a standard magnetic in yet another embodiment. Preferred magnetic material ratings for high energy are from 1.0–1.4 million gauss. Magnetic segment 206 may be attached to top member 204 and bottom member 208 (FIGS. 3, 4, and 35) by any suitable means. It will be appreciated that when top member 204 and bottom member 208 are constructed from steel or material embedded with ferrous particles magnetic segments 206, 220 will magnetically attract top member 204 and bottom member 208. Preferably, where top body member 204 and bottom body member 208 are made of 18 gauge steel, magnetic segment 206 has a thickness of 225 thousandths of an inch. Where top body member 204 and bottom body member 208 are made of 16 gauge steel, magnetic segment 206 has a thickness of 187 thousandths of an inch. The magnetic segment is ¾ of an inch in thickness in one embodiment. All magnetic segments disclosed herein, e.g. 8, 76, 202, 206, 208, 254, 220, 471, 614, are a conventional magnet in one variant and a multi-pole magnet in another variant. Moreover, the magnetic segments disclosed herein can have a pole line P1 or plurality of lines run perpendicular to phantom line F1 (FIG. 3), a magnetic pole line P2 or plurality of pole lines run parallel to phantom line F2 (FIG. 25), or have a magnetic pole line P3 or plurality of pole lines run diagonal to phantom line F3 (FIG. 25).

Figures 31B, 31C:
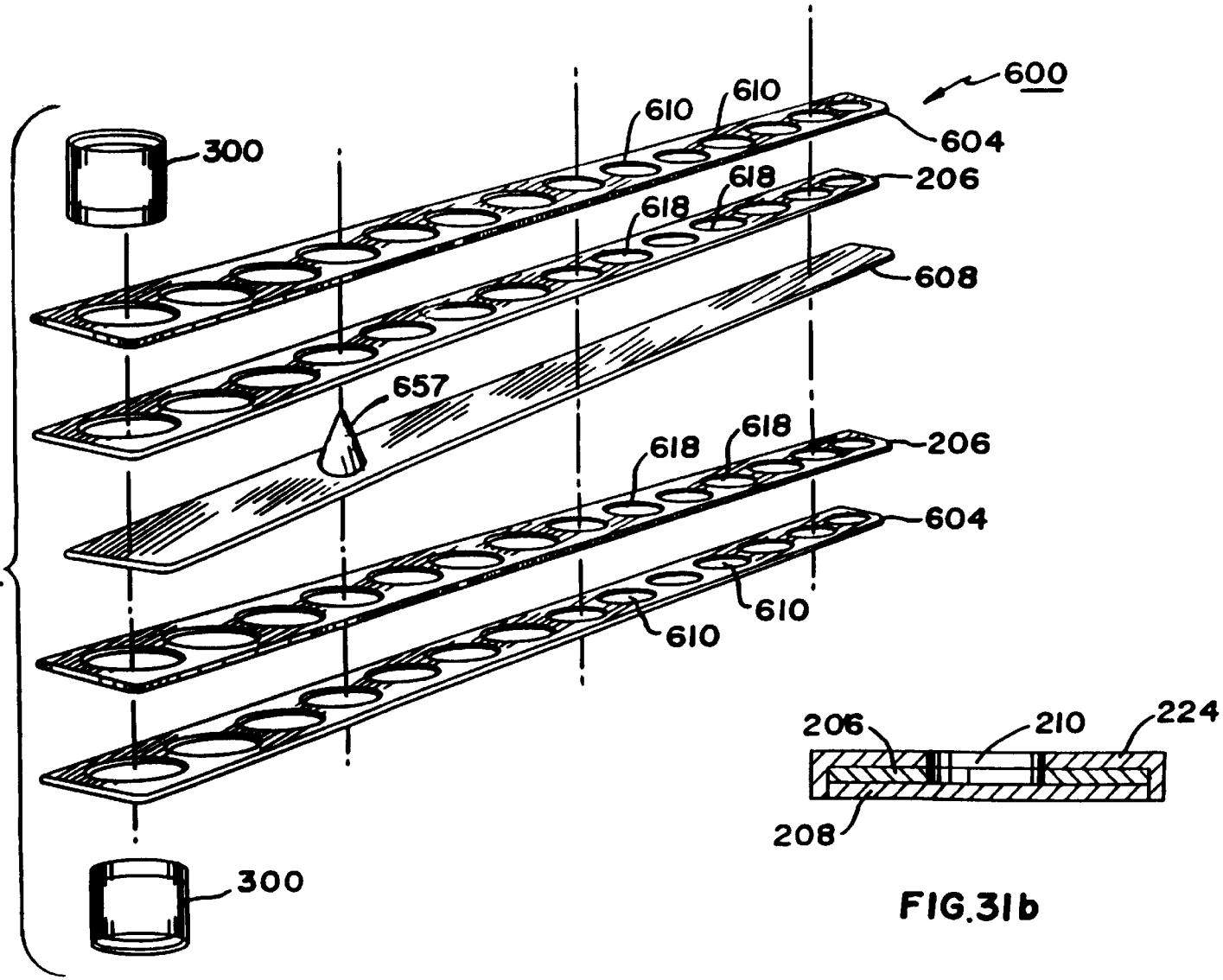
FIG. 31*b* is a cross sectional view of the magnetic tool organizer of FIG. 31*a* along phantom line 31*b*.
FIG. 31*c* is an exploded perspective view of another embodiment of the magnetic tool organizer of FIG. 3.

In a preferred embodiment magnetic segment 206 has a plurality of spaced apart apertures 222 (FIGS. 3, 31*a*, 31*c*, 31*d*, 32, 33, and 35) complimentary to at least part of top body member apertures 210. As illustrated in FIG. 4, magnetic segment 206 is interposed between top body member 204 and bottom body member 208 (FIGS. 3, 4, 31*a* and 35). Magnetic segment 206 is also interposed between top cover 224 and bottom body member 208 (FIG. 31*b*).

Figures 10, 11:
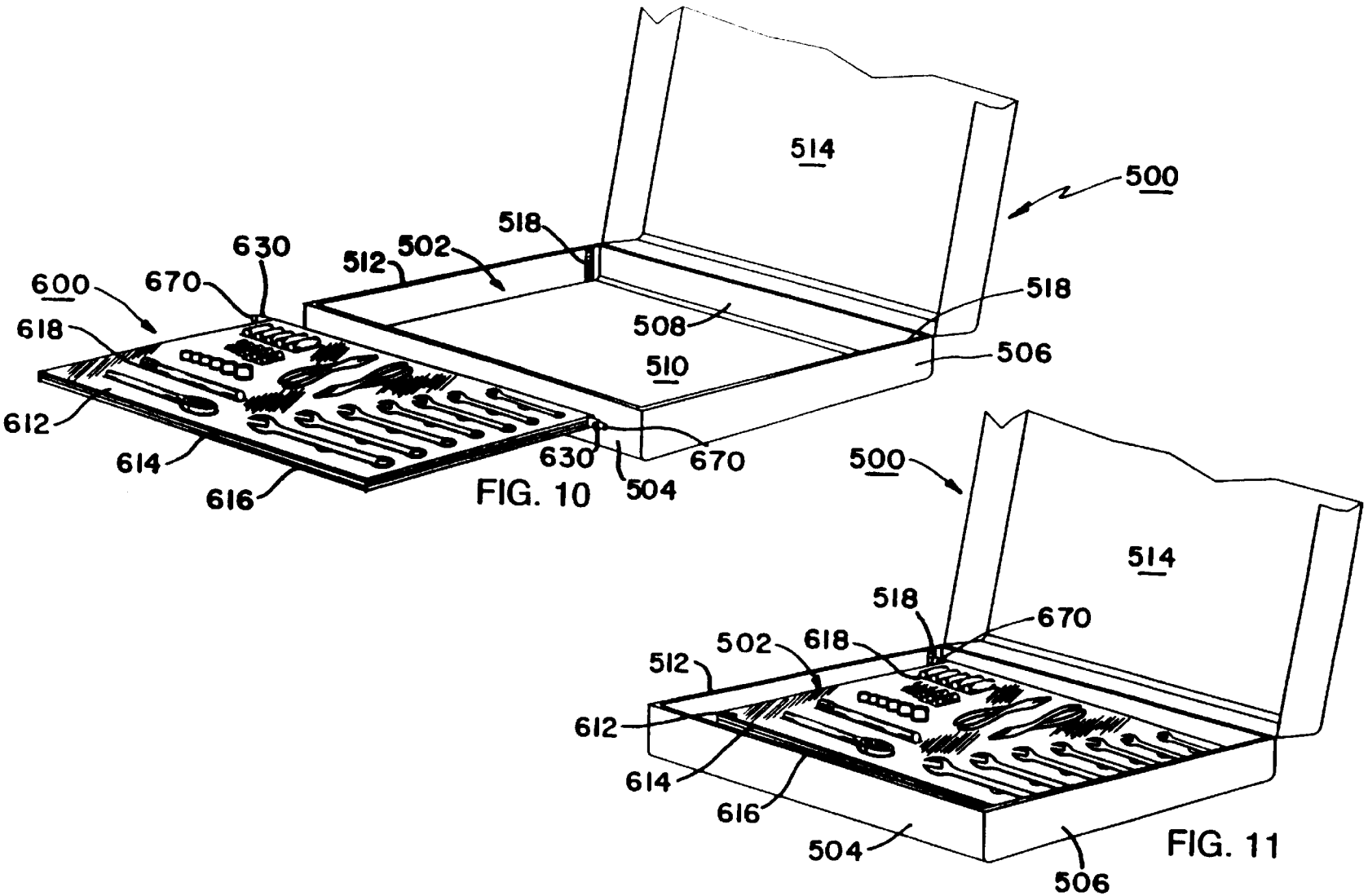
FIG. 10 is a perspective view of a tool holder case and a tool holder page wherein a tool holder page has been removed from the tool holder case.
FIG. 11 is a perspective view of a tool holder case and a tool holder page of FIG. 10 wherein a tool holder page has been inserted into a storage volume of the tool holder case.

Tool holder case 500 is illustrated in FIGS. 10, 11, 12*a*, 12*b*, and 13. Tool holder case 500 comprises a storage volume 502 defined by a first side wall 504, second side wall 506, third side wall 508, fourth side wall 512, compartment floor 510, and lid 514. A tool holder page 600 rests in storage volume 502 as illustrated in FIG. 11. Tool holder page optionally comprises an outside folded edge or other limit stop to keep tools from coming into contact with tools from other tool holder page.

Figure 13:
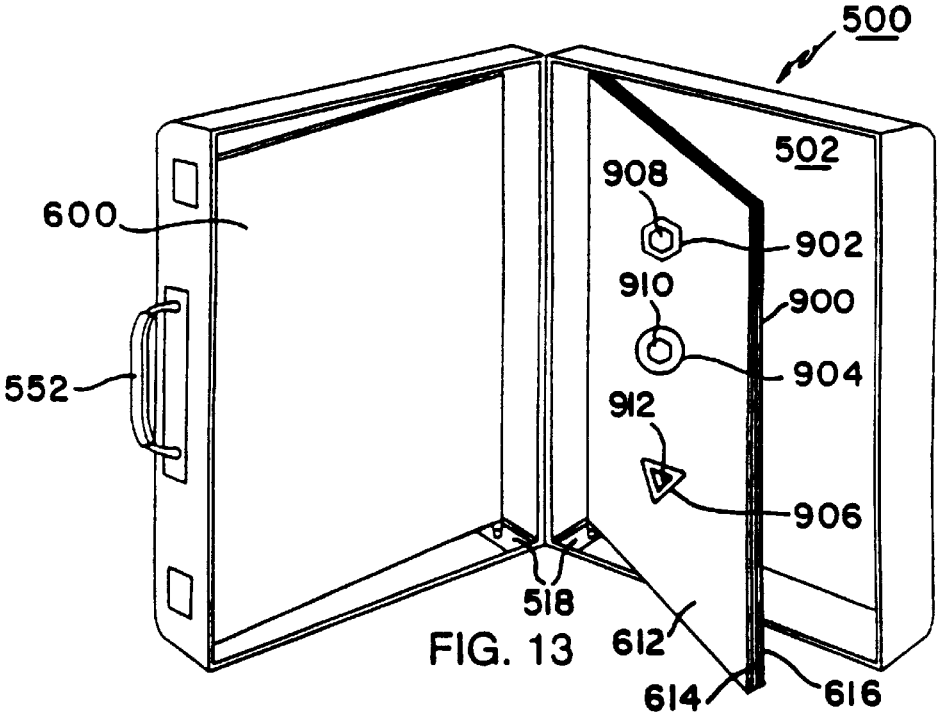
FIG. 13 is an exploded perspective view of the storage volume of the tool holder case of FIG. 10 with tool holder pages from accommodating a plurality of engine parts.
Figure 14:
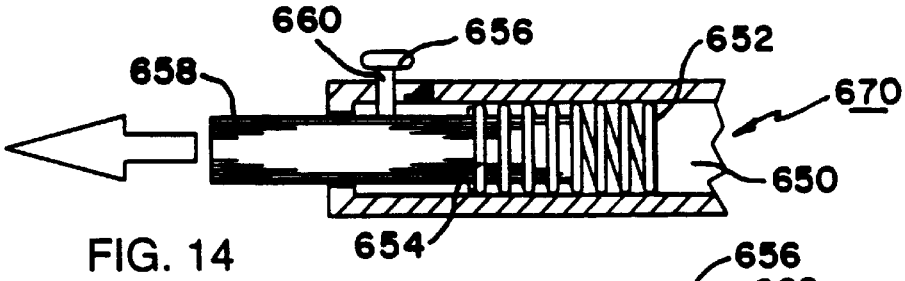
FIG. 14 an exploded side view of a locking mechanism of the tool holder page of FIG. 10 with the locking mechanism in an activated position.
Figure 15:
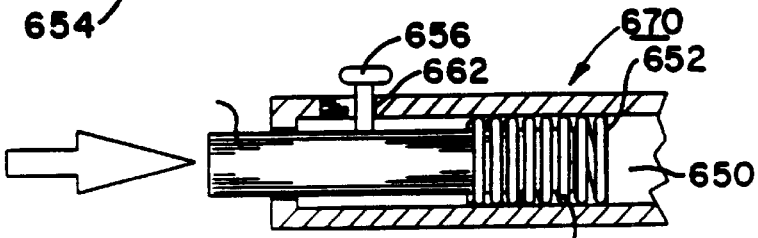
FIG. 15 is an exploded side view of a locking mechanism of the tool holder page of FIG. 10 with the locking mechanism in an inactivated position.

Tool holder case 500 further comprises notched channels 518 (FIGS. 10, 11 and 13). Notched channels 518 are provided for accepting spring loaded latch 670 (FIGS. 10, 11, and 13). Spring loaded latches 670 (FIGS. 14–15) are disposed on edges 630 of tool holder page 600. Spring loaded latch 670 comprises a chamber 650. Chamber 650 retains spring 654, and rod 658. Spring 654 rests against limit stop 652. Rod 658 has stopping member 656. Latch 670 is normally biased in an extended position as viewed in FIG. 14 with stopping member 656 resting against an outer edge of aperture 660. Upon actuation of latch 670 by moving stopping member 656 in a direction toward aperture edge 662 as indicated in FIG. 15, rod 658 moves inward. This feature allows tool holder page 600 to be inserted into case 500, and locked into notched channels 518 (FIG. 11).

Figure 12A:
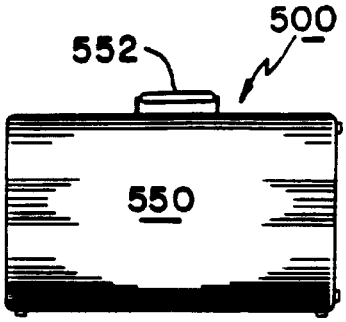
FIG. 12*a* is side view of a first side of the tool holder case FIG. 10.
Figure 12B:
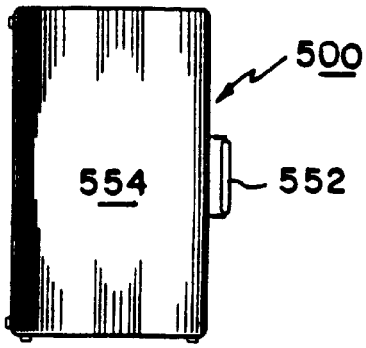
FIG. 12*b* is side view of a second side of the tool holder case of FIG. 10.

FIG. 12*a* is a side view of an exterior first side 550 of tool holder case 500 (FIG. 10). FIG. 12*b* is a side view of a second exterior side 554 of tool holder case 500. Tool holder case optionally comprises handle 552 used to assist in the transport of case 500. As viewed in FIG. 13, tool holder case 500 has a plurality of tool holder pages 600 disposed in storage volume 502. Tool holder case 500 also contains a parts holder page 900 analogous to tool holder page 600.

Parts holder page 900 comprises a magnetic segment 614 (FIGS. 2, 10, 11, 13), analogous to magnetic segment 206 (FIGS. 3, 31*a–d*, 32, 33, and 35), and magnetic segment 220 (FIG. 31). In a preferred embodiment, magnetic segment is constructed from the same types of material as segments 614, 220.

In a preferred embodiment magnetic segment 614, analogous to magnetic segment 206, has a plurality of spaced apart apertures (not shown) complimentary to at least part of top body member apertures 902, 904, 906. Part 908 is disposed within aperture 902. Part 910 is disposed within aperture 904. Part 912 is disposed in aperture 906. Parts 908, 910, 912 are generally constructed of a ferrous metal, or other material that is magnetically attracted to magnetic segment 614. Magnetic segment 614 is interposed between top body member 612 and bottom body member 616 in a manner analogous to the interposition of magnetic segment 206 between top body member 204 and bottom body member 208 (FIGS. 3, 4, 31*a* and 35).

It will be appreciated that tool holder case 500 and parts holder page 600 are particularly useful for airline mechanics who frequently assemble and disassemble airplane engines. Mechanics must inventory the parts that have been disassembled and make sure that all of the parts that have been removed make their way back into the engine assembly. Parts holder page 600 offers a convenient way to inventory engine parts, and reduce the risk of a component not making its way into the engine assembly.

Figures 16, 17, 17A, 17B, 18:
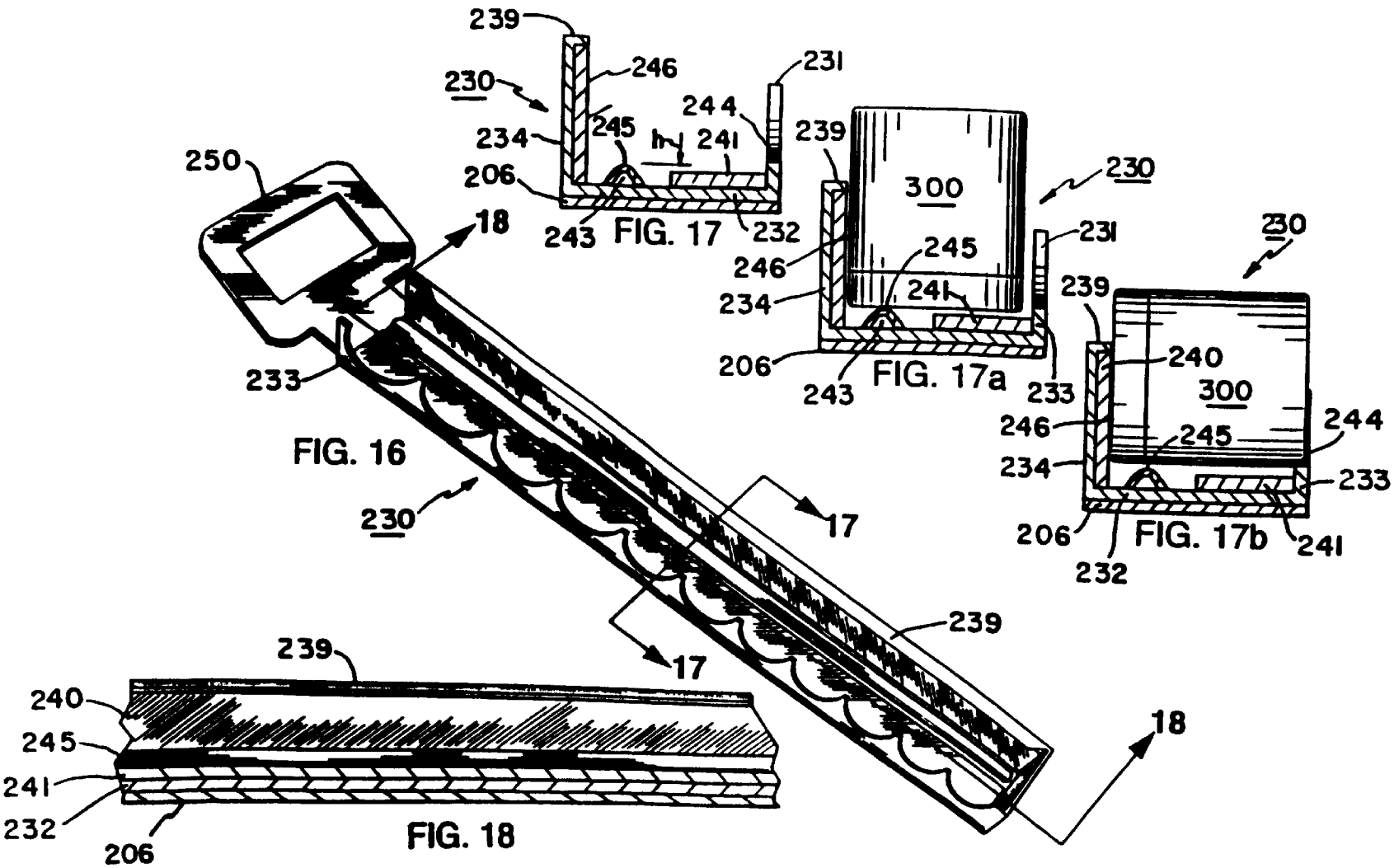
FIG. 16 is a perspective view of a magnetic tool holder for accommodating a plurality of tools.
FIG. 17 is a side cross sectional view of a magnetic tool holder of FIG. 16 along phantom line 17.
FIG. 17*a* is a side cross sectional view of a magnetic tool holder of FIG. 16 along phantom line 17 with a socket vertically disposed on the tool holder.
FIG. 17*b* is a side cross sectional view of a magnetic tool holder of FIG. 16 along phantom line 17 with a socket horizontally disposed on the tool holder.
FIG. 18 is a side cross sectional view of a magnetic tool holder of FIG. 16 along phantom line 18.

FIG. 16 is a perspective view of a magnetic tool holder tray 230 for accommodating a single, or a plurality of tools. Tray 230 comprises a back 232, a base 234 and flanges 233 and 239. Magnetic segments 240, analogous to magnetic segments 206, are positioned so that flanges 233, 239 extend above the strips preferably about 0.03 to 0.125. Bead 245 is formed in back 232 so as to extend above magnetic segment 241 a distance h so that contact points 244, 245, and 246 are utilized to hold tools in place, e.g. socket 300. Flange 233 may be notched as indicated in FIGS. 16, 17–17*b*, and 18–19 or may be straight.

Figures 19, 20, 20A, 20B, 21:
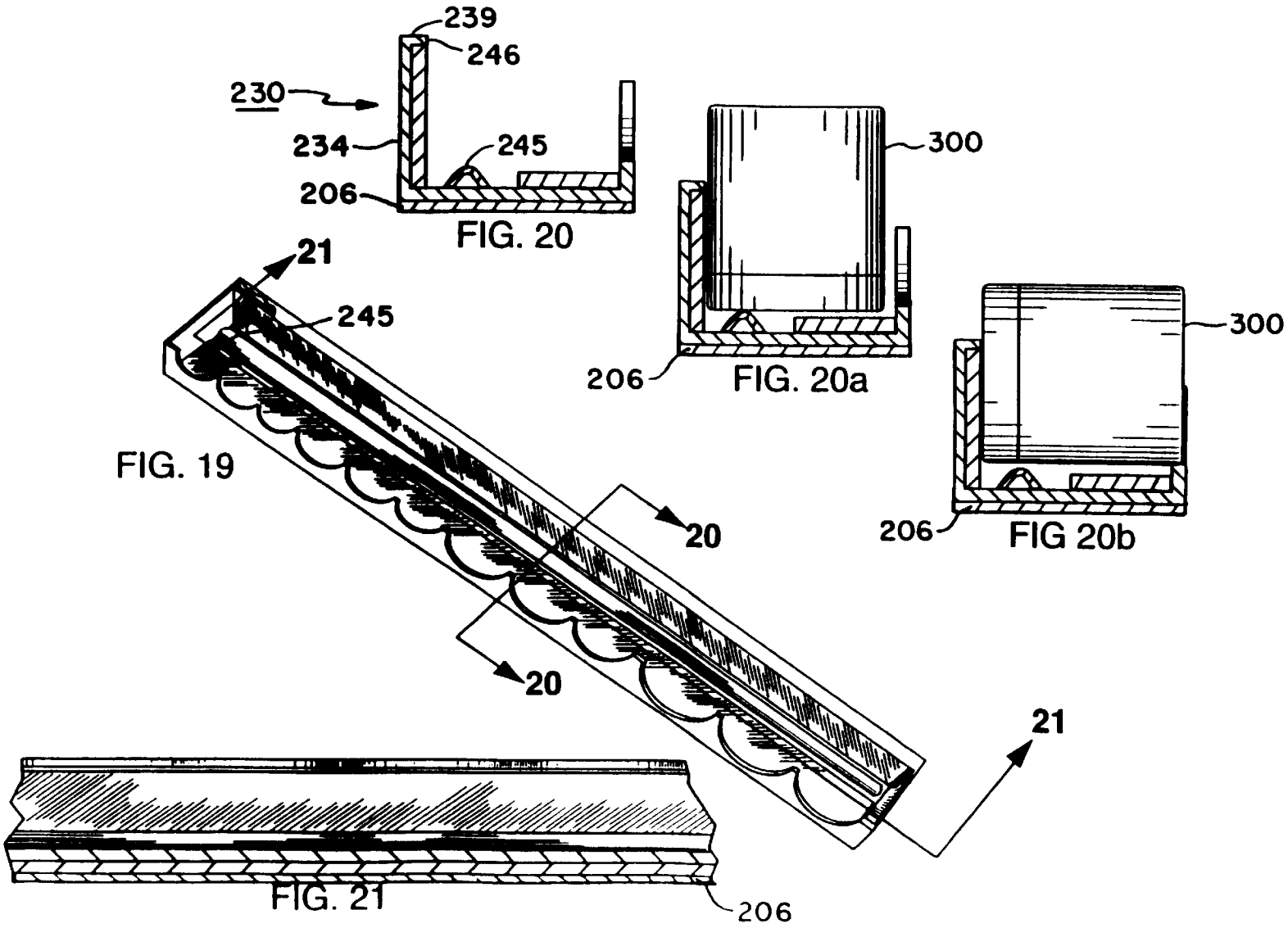
FIG. 19 is a perspective view of a magnetic tool holder of FIG. 16 with the addition of a side wall, and without a handle.
FIG. 20 is a side cross sectional view of a magnetic tool holder of FIG. 19 along phantom line 20.
FIG. 20*a* is a side cross sectional view of a magnetic tool holder of FIG. 19 along phantom line 20 with a socket vertically disposed on the tool holder.
FIG. 20*b* a side cross sectional view of a magnetic tool holder of FIG. 19 along phantom line 20 with a socket horizontally disposed on the tool holder.
FIG. 21 a side cross sectional view of a magnetic tool holder of FIG. 19 along phantom line 21.

Tray 230 comprises a magnetically conductive material such as low to medium grade carbon steel, other ferrous metals, or material having ferrous metal particles embedded therein. The magnetic flux formed around the magnetic strips are focused by flange contact points 244–246. This configuration is beneficial for retaining tools of varying heights and positioning the tools in a manner that the user can identify the sockets being used by positioning them at right angles to their normal positions (FIGS. 17*b*, 20*b*). As illustrated in FIG. 16 tray 230 has optional handle 250. As illustrated in all embodiments of tool holder 230 (FIGS. 16, 17–17*b*, 18, 19, 20–20*b*, 21, 22–24), magnetic segment 206 is added to tray 230.

Figure 23:
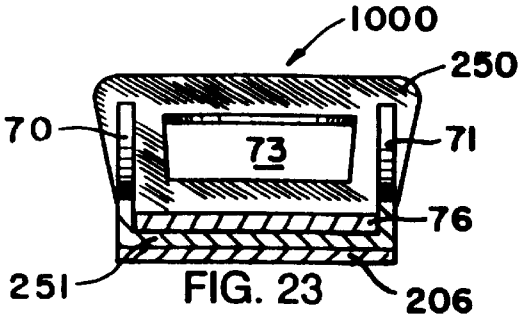
FIG. 23 is a cross sectional view of the magnetic tool holder of FIG. 22 along phantom line 23.
Figure 22:
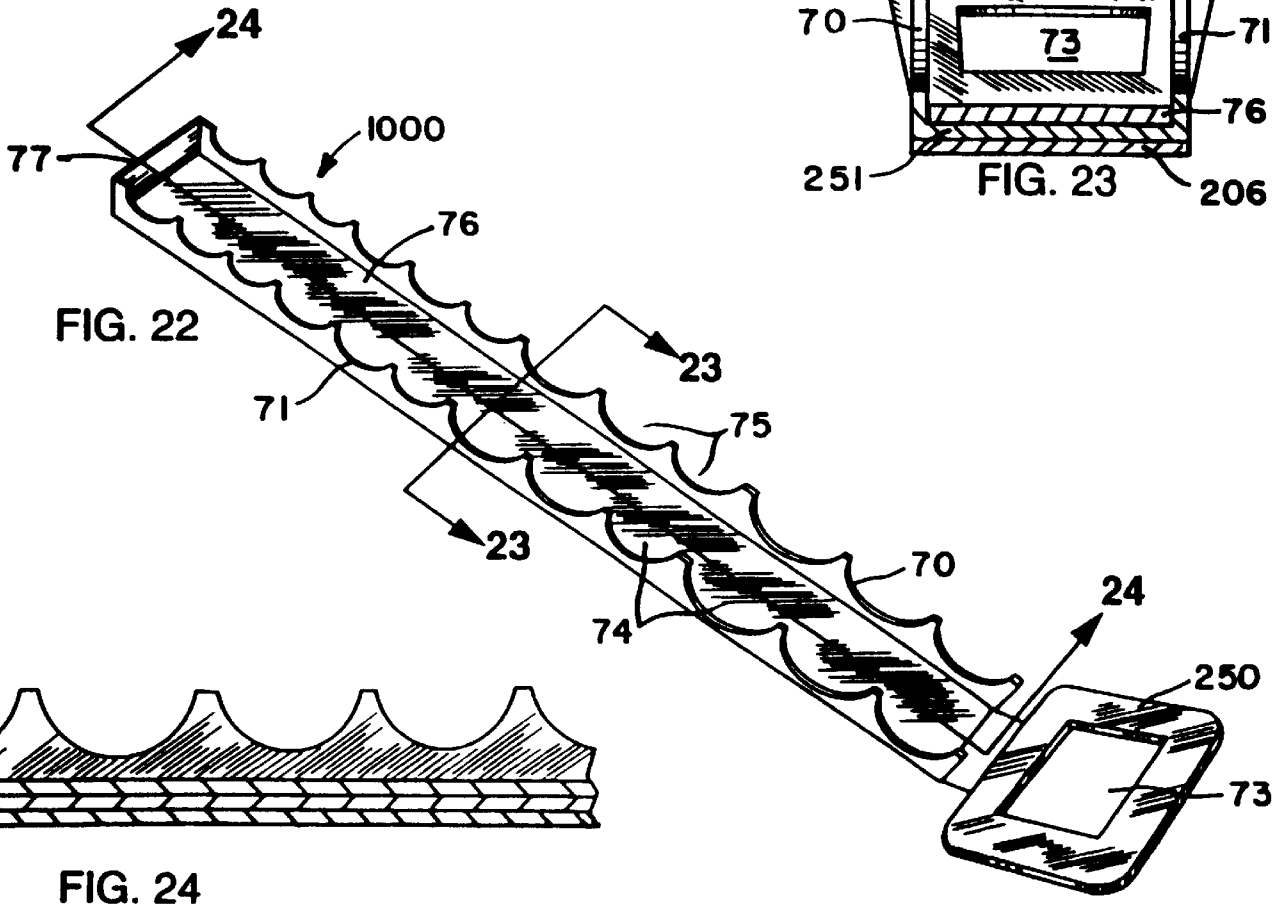
FIG. 22 is a perspective view of an embodiment of a magnetic tool holder with a handle.
Figure 24:
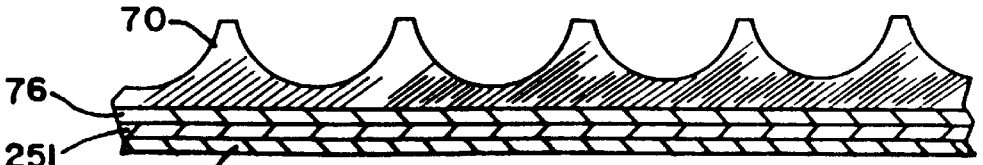
FIG. 24 is a cross sectional view of the magnetic tool holder of FIG. 22 along phantom line 24.

FIGS. 22–24 illustrate a tool tray 1000 having sides 70 and 71 and a handle 250 with an opening 73. Notches 74 and 75 are formed in sides 70 and 71 to hold tools, particularly, sockets. Elastic magnetized material 76 is disposed in the base 251 of tray 1000. Elastic magnetized material is constructed of material analogous to the material from which segments, 206, 614 are constructed. Magnetic segment 206 is disposed below base 251 and fixed thereto by conventional methods.

FIGS. 25–28 illustrate magnetic tool holders 1001, and 1002 that can be utilized in tool box 100. Tool holder 1001 has magnetic segment 254, analogous to segment 206. Segment 254 is surrounded by conductive base 255, preferably a ferrous metal. Base 255 includes bed formation of flanges 258 and 259. Flanges 258 and 259 serve to bend the magnetic flux line of magnetic segment 254 downward and produce forces sufficient to hold the magnetic tool holder in place in tool box 100 and the like.

Figure 27:
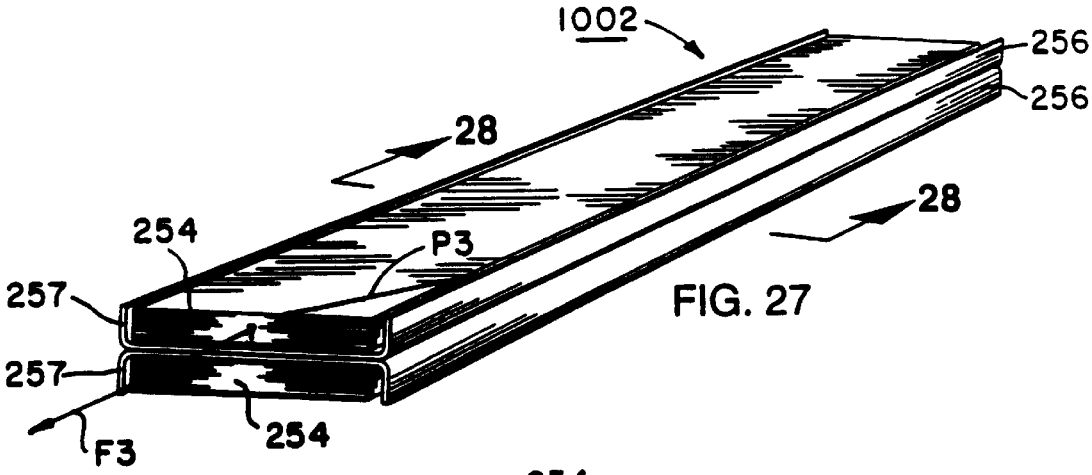
FIG. 27 is a perspective view of another embodiment of a magnetic tool holder.
Figure 28:
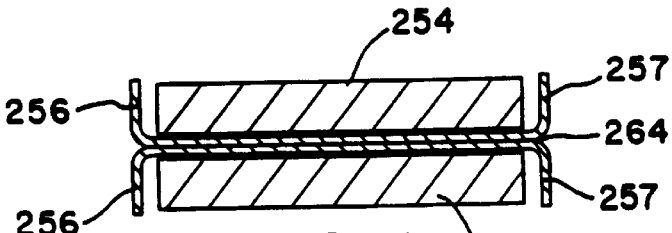
FIG. 28 is a side cross sectional view of the magnetic tool holder of FIG. 27 along phantom line 28.
Figure 29:
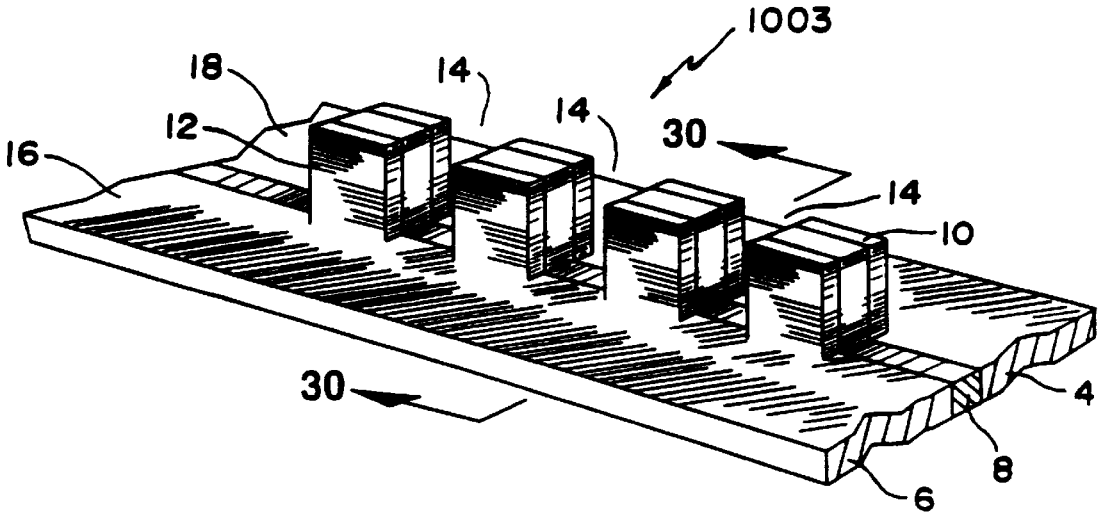
FIG. 29 is a perspective view of another embodiment of a magnetic tool holder.
Figure 30:
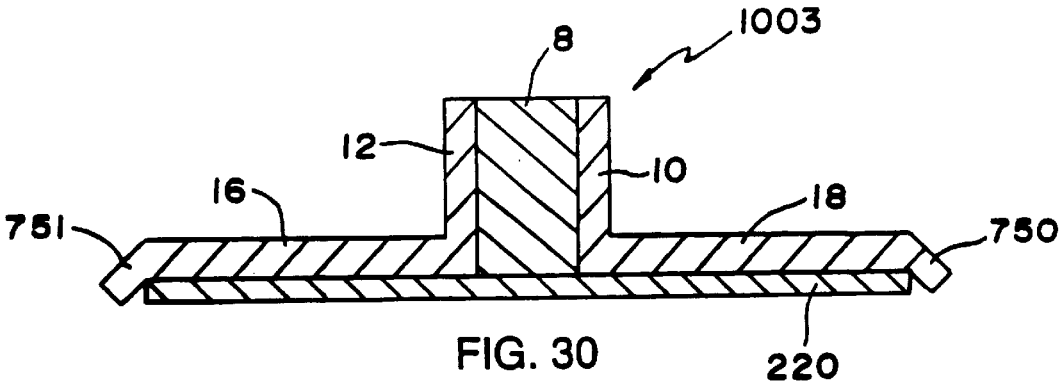
FIG. 30 is a cross sectional view of the magnetic tool holder of FIG. 29.

FIGS. 27 and 28 illustrate magnetic tool holder 1002. Tool holder 1002 includes magnetic segments 254 surrounded by a conductive base 264, preferably constructed from steel. The edges of base 264, 256 and 257 extend above segments 254 in a manner to enhance the magnetic flux of the magnetic segments 254. Tool holder 1002 is utilized in tool box 100. FIGS. 29 and 30 illustrate a magnetic tool holder 1003. Tool holder 1003 comprises a magnetic member 8, analogous to magnetic member 206. Magnetic member 8 is interposed between side wall 10 and side wall 12. Side wall 10 is, preferably, integral with base 16. Side wall 12 is, preferably, integral with base 18. Base 18, base 16, and side walls 10, 12, are made from a conductive material, preferably, a ferrous metal. Base 18 has an optional leg 751 preferably at a 45 degree angle to base 18. Base 16 has an optional leg 750 preferably at a 45 degree angle to base 16. Magnetic segment 220 is optionally interposed between legs 750, 751.

FIGS. 31*a* and 31*b* illustrates magnetic tool holder 402 wherein magnetic segment 206 is enclosed by body member 208 and cover member 224. It will be appreciated that cover member 224, in combination with body member 208, shield the magnetic flux lines of magnetic segment 206 from the surrounding environment. Magnetic segment 206, body member 208, and cover member 224 are attached by any suitable attaching means. The present invention contemplates that additional shielding material may be interposed between segments 204, 208 and magnetic segment 206.

FIG. 31*c* is an exploded perspective view of another embodiment of the magnetic tool holder of FIG. 3. Magnetic tool holder 600 comprises a plurality of exterior body members 604 (FIG. 31*c*), 614 (FIG. 31*d*) having a plurality of spaced apart body member apertures 610 of a size and shape for accommodating at least one surface of a tool. Exterior body members 604, 614 can be constructed of any suitable material. Apertures 610 are analogous to apertures 210, 212, 210, 214, 216 and 218 as previously described, and are organized in a planar array according to an outline of at least one surface of a tool as described above.

Figure 31D:
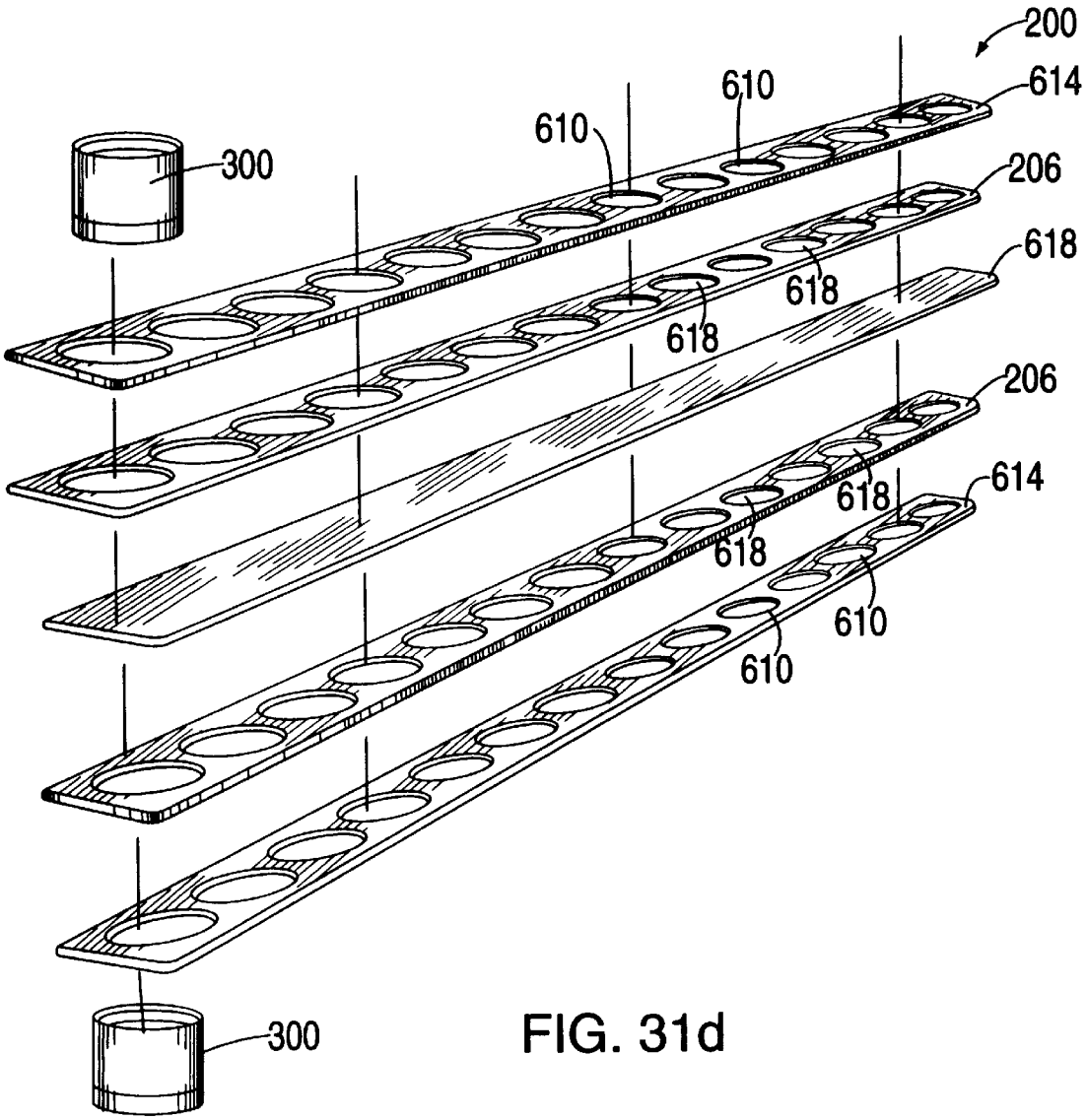
FIG. 31*d* is an exploded perspective view of an embodiment of the magnetic tool organizer of FIG. 31*c*.
Figure 32:
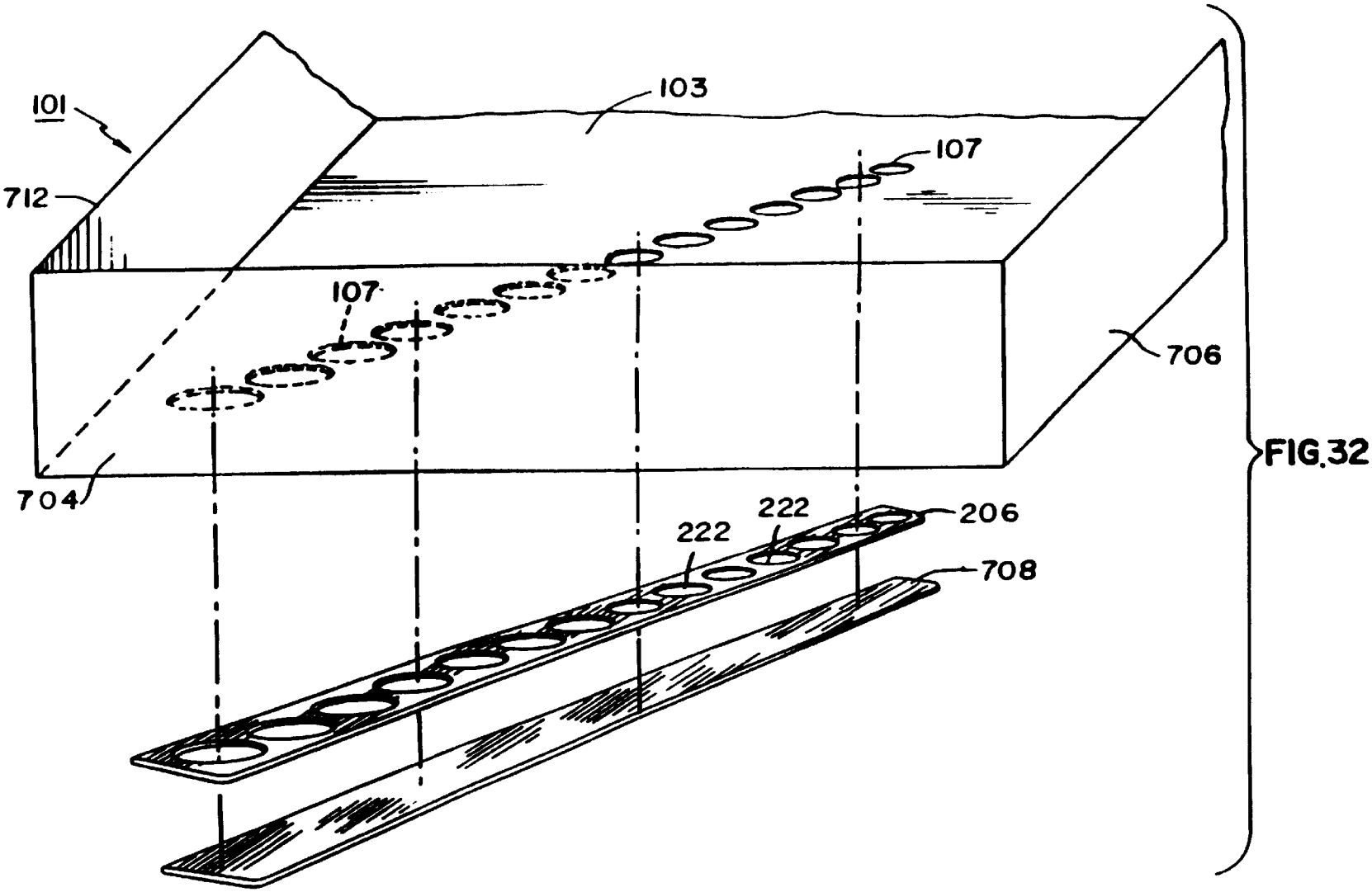
FIG. 32 is a perspective view of a tool box compartment floor with a plurality of apertures disposed thereon, an interior body member, and an exterior body member.

Tool organizer 600 has an interior body member 608 (FIG. 31*c*), 618 (FIG. 31*d*) respectively. As illustrated in FIG. 31*c*, interior body member 608 is preferably, a ferrous metal, e.g. steel, and exterior body members 604 are preferably a plastic. As illustrated in FIG. 31*d*, interior body member 618 is preferably a plastic and exterior body members 614 are preferably a ferrous metal, e.g. steel. Optionally, body member 608 has a centering protrusion 657. Protrusion 657 is cone shaped in the embodiment in FIG. 31*c*, however, protrusion may be any other geometric shape to assist in the entering of a tool in aperture 610. It will be understood that member 604 may be of a height to accommodate deep sockets.

Magnetic segments 206 (FIGS. 31*c* and 31*d*) are analogous to magnetic segments 206 of FIG. 3 and have a plurality of spaced apart apertures 618 complimentary to at least part of exterior body member apertures 610. Magnetic segments 206 are interposed between exterior body members 604, and interior body member 608 (FIG. 31*c*). Magnetic segments 206 are interposed between exterior body members 614, and interior body member 618 (FIG. 31*d*).

FIGS. 32, 33, 34, and 35 illustrates compartment 101 of tool box 100 of FIG. 1. Compartment 101 has a first wall 712, a second wall 704 (FIGS. 32, 35, and 35*a*), 804 (FIG. 33), a third wall 706, and a forth wall (not pictured). Compartment 101 has compartment floor 103.

Compartment floor 103 comprises compartment floor apertures 107 (FIGS. 32 and 33) disposed on floor 103. Compartment floor apertures 107 are of a size and shape for accommodating at least one surface of a tool. By way of example, compartment floor apertures accommodate a socket 300. Bottom body member 708 is analogous to bottom body member 208 and serves to prevent tool 300 from falling through apertures 107, 222. Magnetic segment 206 has at least one aperture 222 complimentary to at least part of said compartment floor apertures 107 and is interposed between compartment floor 103 and bottom body member 708.

Figure 33:
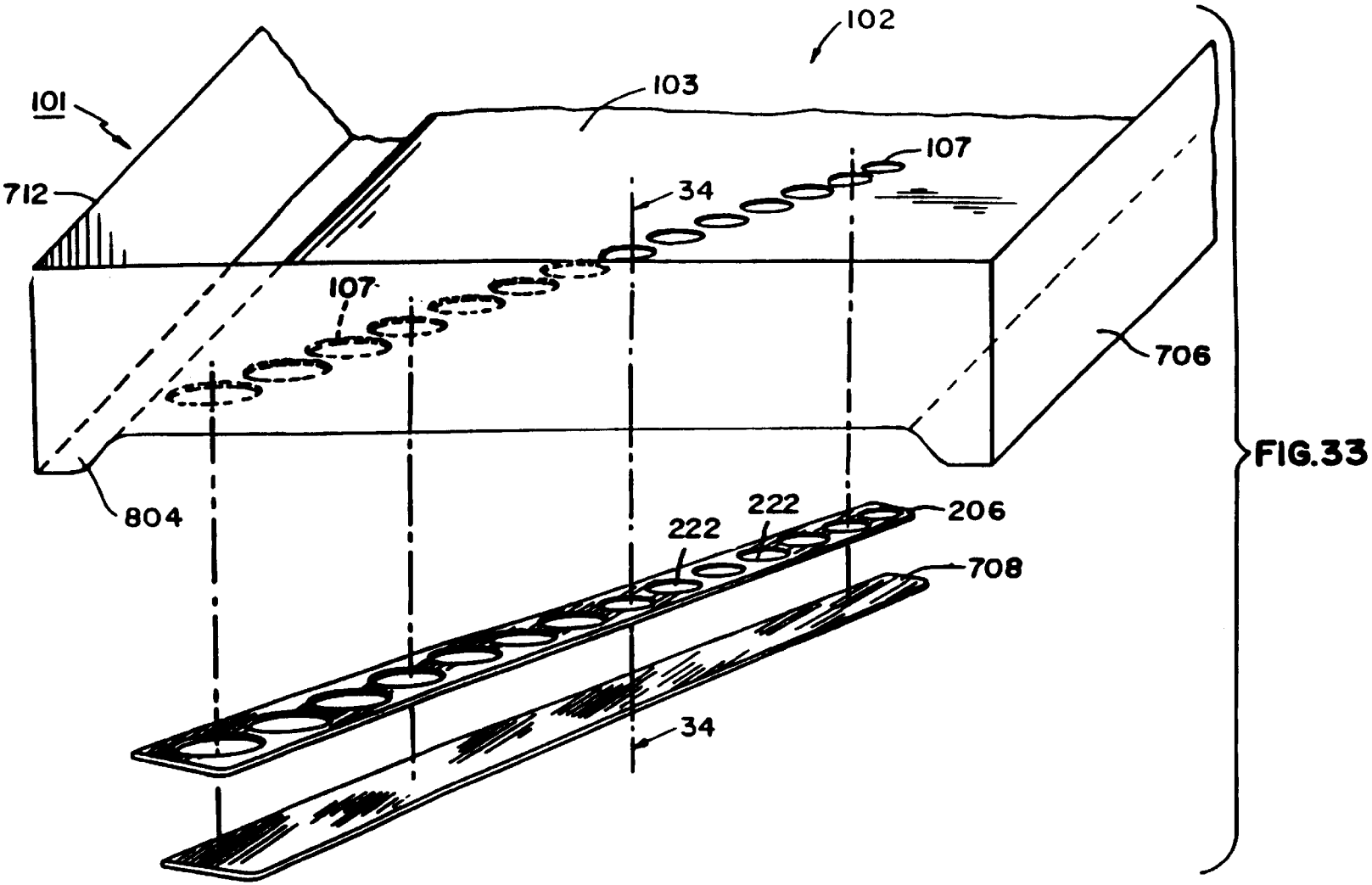
FIG. 33 is another embodiment of the tool box compartment floor of FIG. 32 wherein the floor is raised into the storage volume of the tool box compartment.

Optionally, compartment floor 103 protrudes into storage volume 102 (FIG. 33). It will be appreciated that this feature allows for the passage of compartment 901 (FIG. 1) under compartment 101 without interference from magnetic segment 206, and body member 708.

Figures 34, 35A:
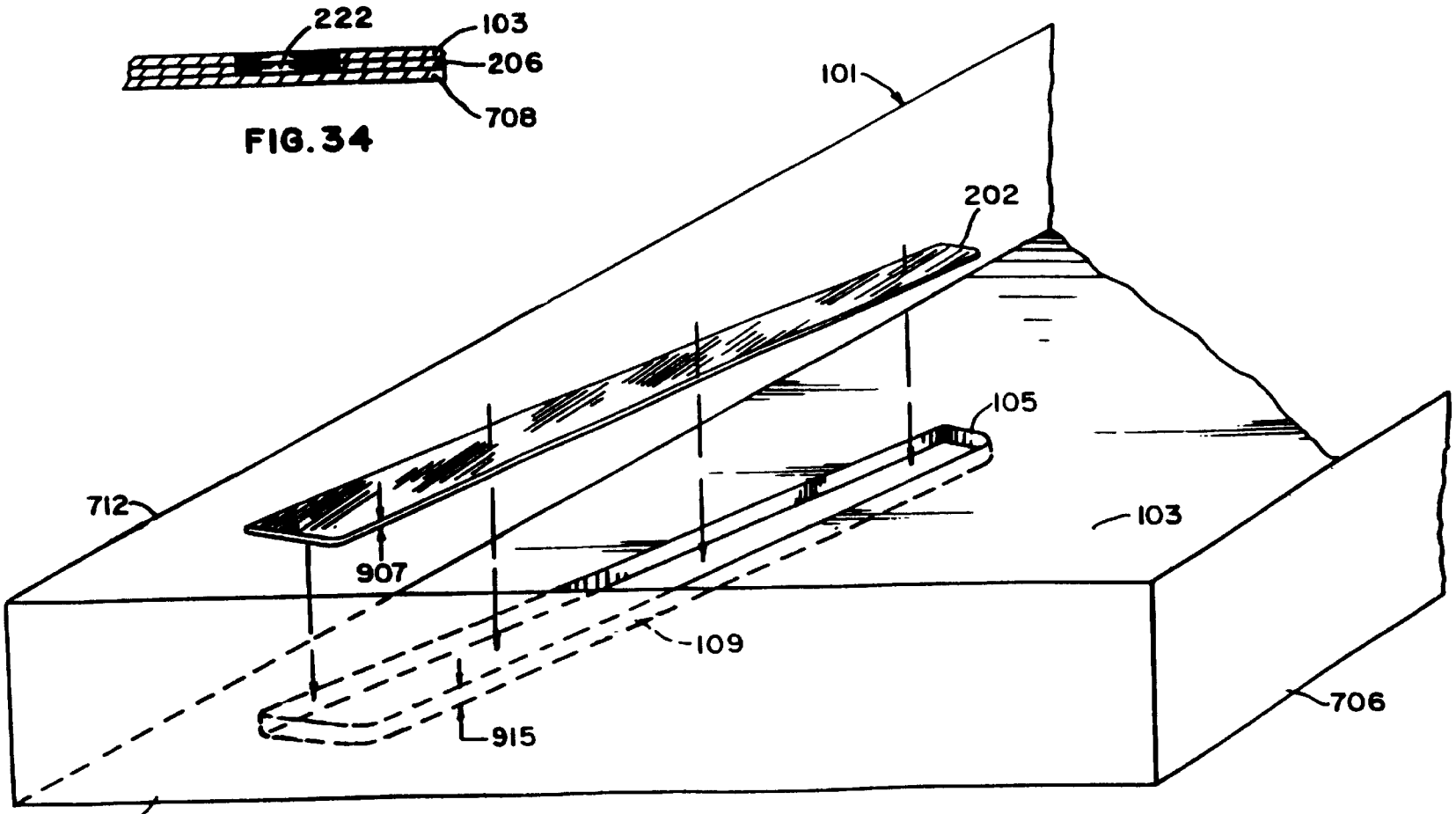
FIG. 34 is a cross sectional view of the tool box compartment floor of FIG. 33 along phantom line 34.
FIG. 35*a* is a exploded perspective view of another embodiment of a tool box compartment floor with an indentation for receiving a magnetic tool organizer, and a magnetic body member disposed therein.

In a further embodiment as illustrated in FIGS. 35*b* and 35*a*, compartment floor 103 has a first side wall 465 and a second side wall 467 substantially perpendicular to floor 103, and cap 469 as defined by floor 103. Side wall 465 has an aperture 470. Magnetic segment 471, analogous to magnetic segment 206, has an aperture 475 complimentary to aperture 470. Inner body member 474 is disposed beneath magnetic segment 474. It will be appreciated that tool 300 will be magnetically held in aperture 470 by the tool's attraction to magnetic segment 471.

Figure 35:
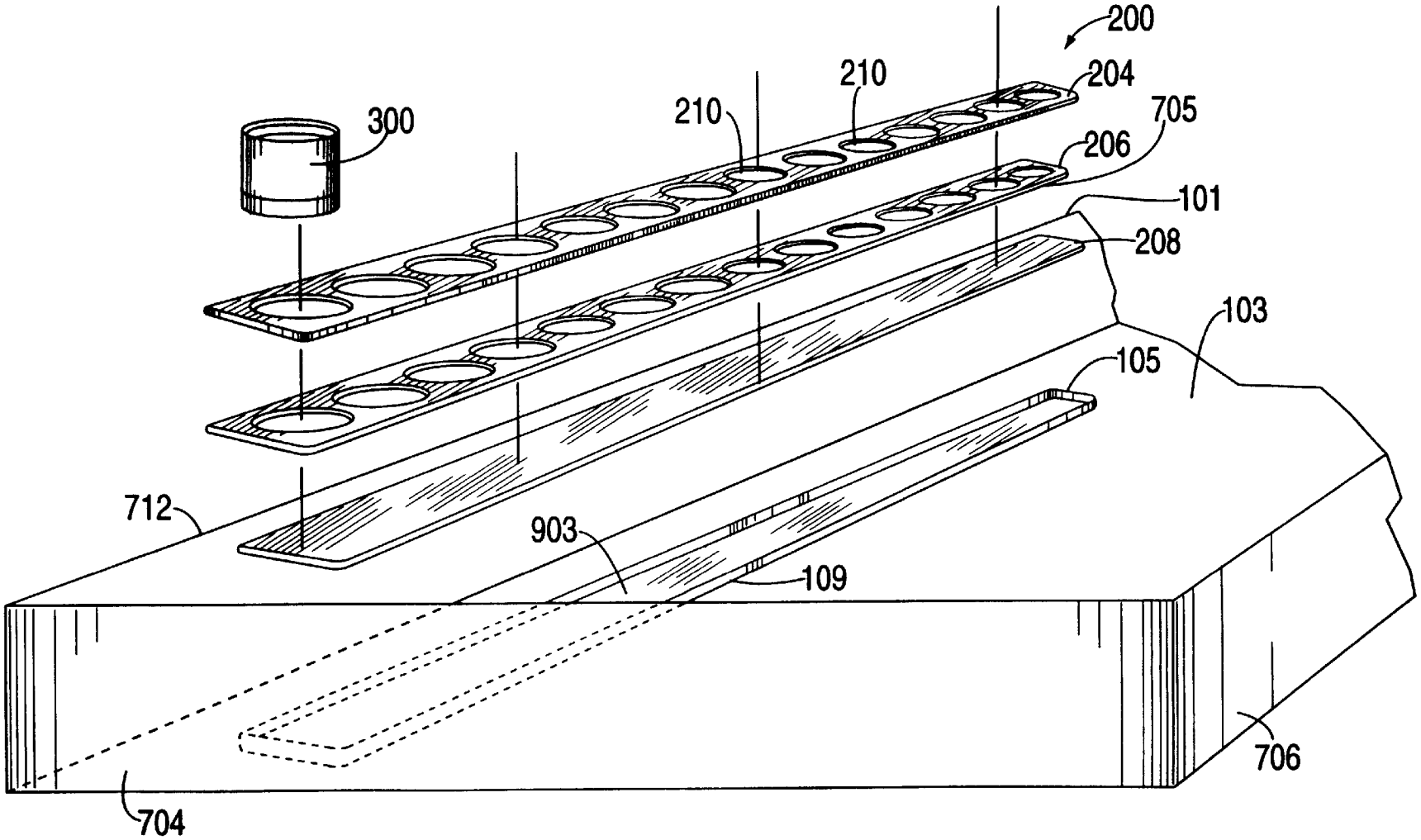
FIG. 35 is a perspective view of another embodiment of a tool box compartment floor with an indentation for receiving a magnetic tool organizer, and an exploded view of the magnetic tool organizer of FIG. 3.

As illustrated in FIG. 35, compartment floor 103 has at least one compartment floor indentation 105 of a size and shape for accommodating magnetic tool organizer 200 (FIG. 3). Indentation 105 is disposed on compartment floor 103. Preferably compartment floor 103 is constructed of a metal or a material impregnated with ferrous particles. Indentation 105 has interior side wall 109 around the perimeter of indentation 105. It will be appreciated that side wall 109 will be magnetically attracted to side wall 905 (FIG. 35) of magnetic segment 206 of tool organizer 200. Optionally, magnetic segment 202, analogous to segment 206, rests in indentation 105 (FIG. 35*a*). Preferably, thickness 907 of magnetic segment 202 is less than the height 915 of wall 109.

Figure 36:
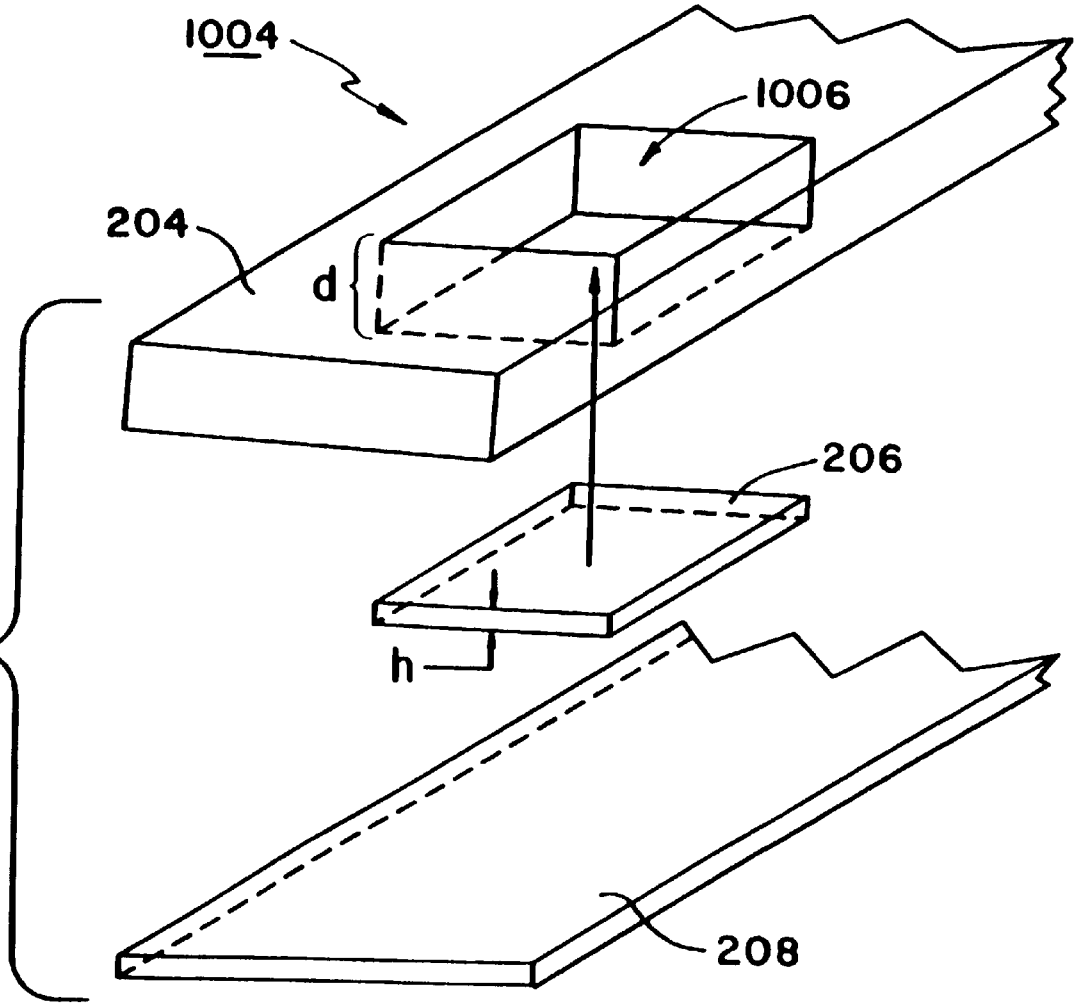
FIG. 36 is a perspective view of a magnetic tool organizer wherein a magnetic segment is disposed in an aperture of a top body member.

FIG. 36 is an exploded perspective view of magnetic tool organizer 1004. Magnetic tool organizer 1004 has a top body member 204 with an aperture 1006. Aperture 1006 is of a size and shape to accommodate a tool. Disposed within aperture 1006 is magnetic segment 206. The height of magnetic segment h is preferably less than the depth, d, of aperture 1006. Magnetic segment 206, top body member 204, and bottom body member 208 are attached by any suitable means.

Figure 37C:
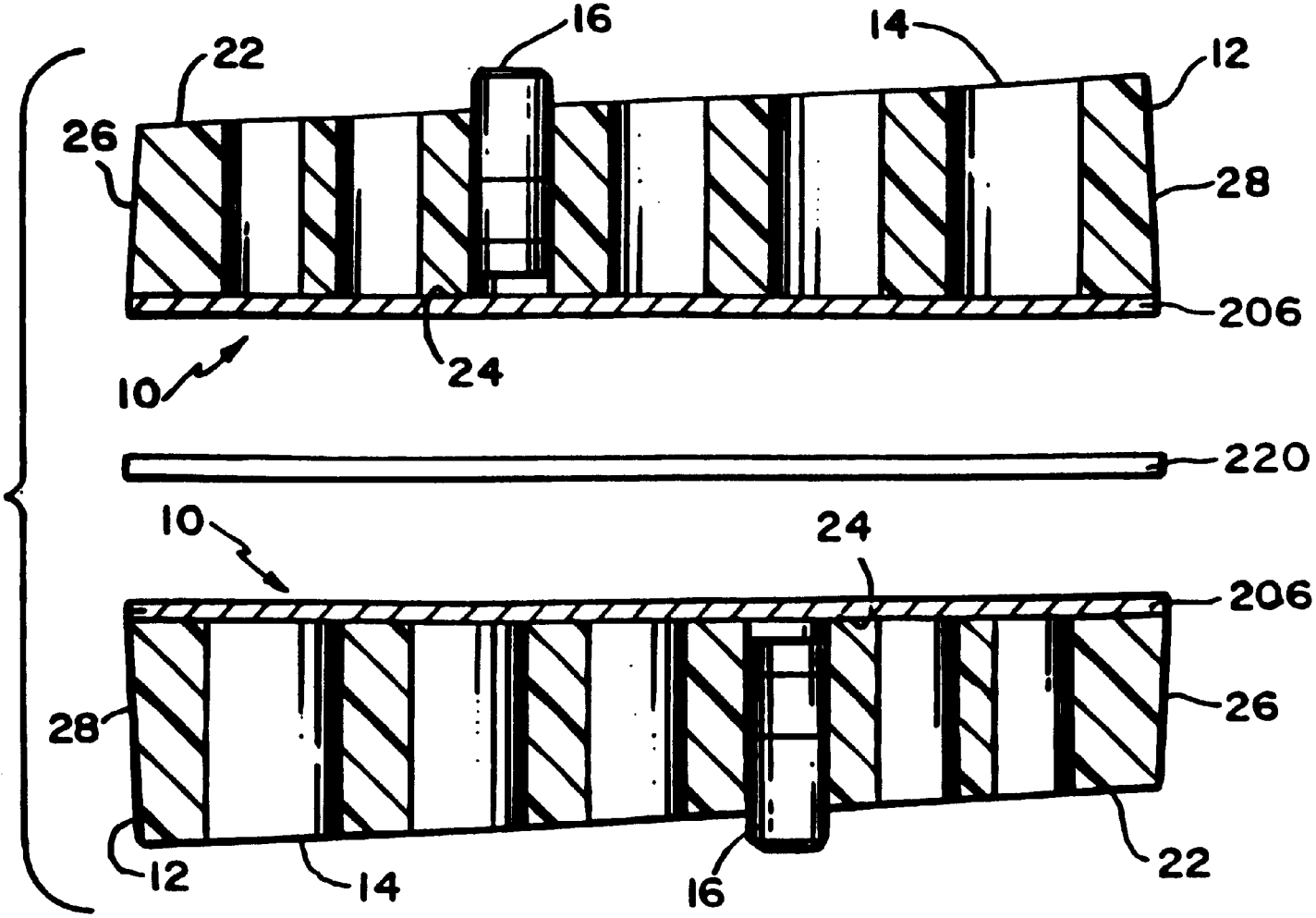
FIG. 37*c* is a cross sectional view of an embodiment of the magnetic tool organizer of claim 37 with the addition of a second non-metallic body member.

FIGS. 37–37*c* illustrate a perspective view of different embodiments of a magnetic tool holder 10. Tool holder 10 comprises a tool retaining body member 12 of an elongated material that may be made from any suitable material. Tool retaining body member 12 is preferably constructed from plastic. Tool retaining body member 12 has upper and lower surface 22 and 24, respectively. Tool retaining body member 12 has substantially parallel sides S1 and S2 and side ends 26 and 28. Surfaces 22 and 24 extend away from each other from end 26 to end 28. Tool retaining body member 12 includes a plurality of circular cross-sectioned bores 14 that extend through the tool retaining body member 12 from upper surface 22 to lower surface 24 of member 12. Bore 14 is formed to receive a tool 16, and bores of different diameters can be made so that tools 16 can be arranged in a predetermined order. Bores 14 are loosely dimensioned to loosely receive tools 16. Tool retaining body member 12, preferably is constructed so that a tool 16 protrudes from each bore 14 a sufficient amount to provide for one-handed removal and replacement of the socket head 16 from the bore 14. Tool retaining body member 12 is also preferably constructed so that bores 14 increase in length from first end 26 to second end 28 of tool retaining body member 12.

Body member 204, member 206, member 208, and member 220 are attached to and cover lower surface 24 of tool retaining body member 12. In one embodiment, body member 204 is constructed from a ferrous metal, e.g. steel, magnetic segment 220 is constructed as described above, and body member 208 is constructed from a ferrous metal, e.g. steel (FIG. 37). In yet another embodiment, body member 208 is interposed between magnetic segments 220 (FIG. 37*b*). In yet a further embodiment, magnetic segment 206 is interposed between body members 204, and 208, respectively (FIG. 37*a*). In yet a further embodiment, magnetic segment 220 is interposed between body members 208 (not pictured). Body members 204, 208, and magnetic segments 206, 220, are attached to tool retaining body member 12 by any suitable means. Preferably, members and segments are attached to tool retaining body member 12 with screws.

As illustrated in FIG. 37*c*, body members 204, 208, and magnetic segments 206, 220 can be interposed between a plurality of tool retaining body members 12. By way of example, magnetic segment 220 is interposed between body members 206, which is in turn interposed between tool retaining body members 12. The present invention contemplates interposing a variety of body members between tool retaining body members 12. It will be appreciated that the interposition of the various body members and magnetic segments between tool retaining body member 12 allows mounting of the assembly on surfaces constructed of or comprising ferrous particles. Moreover, various magnetic tool organizers described herein can all be used in the tool box compartment 101.

A method of assembling a tool display utilizes magnetic tool organizers 200, 201, 202, 400, 402, 600, 1001, 1002, 1003, and other embodiments is disclosed herein. By way of example, a tool display comprises a magnetic tool organizer 200 and at least one tool 300 (FIG. 1). By way of further example, a tool display includes a tool box 100, tool case 500, a magnetic tool organizer 200 9 (or other variations thereof), and a tool 300. P A method of assembling a tool display comprises the steps of providing a magnetic tool organizer 200, and inserting a tool, e.g. socket 300, into an aperture 210 (FIG. 3) disposed on magnetic tool organizer 200. Accordingly, compared to traditional methods of assembling tool displays utilizing traditional spring clips, the time, labor, and cost savings are greatly enhanced.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. A magnetic tool organizer having a plurality of periodic protuberances, each said periodic protuberance comprising:

a pair of magnetically attracted members;

a magnetically attracting material disposed between said magnetically attracted members;

a magnetically attracting base member disposed on said magnetically attracting material; and a second magnetically attracting member sized for mounting said magnetic tool on a compatible surface.

2. The magnetic tool organizer of claim 1 in which said magnetically attracting material is substantially congruent to at least one of said magnetically attracted members of said pair.

3. The magnetic tool organizer of claim 1 in which said pair of magnetically attracted members and said magnetically attracting material are each substantially congruent to one another.

4. The magnetic tool organizer of claim 1 in which said protuberances are substantially rectangularly shaped.

5. The magnetic tool organizer of claim 1 further comprising spaces between respective periodic protuberances of a size and shape to accommodate a tool or portion thereof.

6. The magnetic tool organizer of claim 1 further comprising a base member adjacent to said protuberances.

7. The magnetic tool organizer of claim 6 in which said base member is substantially perpendicular to said pair of magnetically attracted members.

8. The magnetic tool organizer of claim 1 in which said magnetically attracted member is a metal.

9. The magnetic tool organizer of claim 1 further in which said magnetically attracted member is steel.

10. The magnetic tool organizer of claim 1 further in which at least some of said protuberances are spaced at non-uniform intervals one from another.

11. The magnetic tool organizer of claim 1 further in which all of said protuberances are spaced at non-uniform intervals one from another.

12. A magnetic tool organizer having two or more periodic protuberances, each of said periodic protuberances comprising a pair of magnetic members, a magnetically conductive material disposed between said pair of magnetic members and a magnetic base member sized to mount said magnetic tool organizer on a compatible surface.

13. The magnetic tool organizer of claim 12 further comprising a plurality of tools therein.

14. A magnetic tool organizer having a plurality of periodic protuberances, each said periodic protuberance comprising a pair of magnetically attracted members, and a magnetically attracting member disposed between said pair magnetically attracted members, said magnetic tool organizer further comprising a top body member having a body member aperture of a size and shape for accommodating at least one surface of a tool, and a magnetic segment having an aperture complimentary to at least part of said top body member aperture, said magnetic segment attached to said top body member.

* * * * *